US009689588B2

(12) United States Patent
Matsuura et al.

(10) Patent No.: US 9,689,588 B2
(45) Date of Patent: Jun. 27, 2017

(54) REFRIGERATING CYCLE APPARATUS

(71) Applicant: Panasonic Intellectual Property Management Co., Ltd., Osaka (JP)

(72) Inventors: Takahiro Matsuura, Osaka (JP); Iori Maruhashi, Saitama (JP); Michiyoshi Kusaka, Osaka (JP); Tomoichiro Tamura, Osaka (JP); Bunki Kawano, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 203 days.

(21) Appl. No.: 14/823,674

(22) Filed: Aug. 11, 2015

(65) Prior Publication Data

US 2016/0054033 A1 Feb. 25, 2016

(30) Foreign Application Priority Data

Aug. 21, 2014 (JP) ..... 2014-168045

(51) Int. Cl.
*F25B 1/00* (2006.01)
*F25B 1/10* (2006.01)
(Continued)

(52) U.S. Cl.
CPC ..... *F25B 1/10* (2013.01); *F25B 1/06* (2013.01); *F25B 25/005* (2013.01); *F25B 40/00* (2013.01);
(Continued)

(58) Field of Classification Search
CPC ..... F25B 1/10; F25B 25/005; F25B 41/04; F25B 1/06; F25B 40/00; F25B 41/003;
(Continued)

(56) References Cited

U.S. PATENT DOCUMENTS

2014/0053595 A1 2/2014 Kawano et al.
2014/0053596 A1 2/2014 Komori et al.

FOREIGN PATENT DOCUMENTS

DE 202009017577 U1 5/2010
DE 102012004094 B3 6/2013
(Continued)

OTHER PUBLICATIONS

The Partial European Search Report dated Jan. 16, 2016 for the related European Patent Application No. 15180125.5.

*Primary Examiner* — Len Tran
*Assistant Examiner* — Ana Vazquez
(74) *Attorney, Agent, or Firm* — McDermott Will & Emery LLP

(57) ABSTRACT

A refrigerating cycle apparatus includes an evaporator, a compressor, a condenser, a feeding channel, a main circuit that circulates a refrigerant including fluid whose saturated vapor pressure at ordinary temperature is a negative pressure as a main component, a heat absorption circuit including a heat absorption heat exchanger, a heat release circuit including a heat release heat exchanger, an internal heat exchanger that allows indirect heat exchange between the fluid flowing through the heat absorption circuit and the fluid flowing through the heat release circuit, at least one of a heat absorption bypass channel and a heat release bypass channel, and at least one of a flow rate adjustment mechanism for heat absorption that adjusts a flow rate of the fluid flowing through the heat absorption bypass channel and a flow rate adjustment mechanism for heat release that adjusts a flow rate of the fluid flowing through the heat release bypass channel.

13 Claims, 12 Drawing Sheets

(51) Int. Cl.

| | |
|---|---|
| ***F25B 41/00*** | (2006.01) |
| ***F25B 49/02*** | (2006.01) |
| ***F25B 1/06*** | (2006.01) |
| ***F25B 25/00*** | (2006.01) |
| ***F25B 40/00*** | (2006.01) |
| ***F25B 41/04*** | (2006.01) |
| ***F25B 47/02*** | (2006.01) |

(52) U.S. Cl.
CPC ..... *F25B 41/003* (2013.01); *F25B 41/04* (2013.01); *F25B 47/02* (2013.01); *F25B 49/02* (2013.01); *F25B 2339/047* (2013.01); *F25B 2400/04* (2013.01); *F25B 2400/0401* (2013.01); *F25B 2600/2501* (2013.01)

(58) Field of Classification Search
CPC ..... F25B 2600/2501; F25B 49/02; F25B 2339/047; F25B 2400/04; F25B 2400/0401
See application file for complete search history.

(56) References Cited

FOREIGN PATENT DOCUMENTS

| | | | | |
|---|---|---|---|---|
| EP | 2489774 | A1 | | 8/2012 |
| JP | 2006-097989 | | | 4/2006 |
| JP | 2008-164187 | A | | 7/2008 |
| JP | 2008275288 | A | * | 11/2008 |
| WO | 2012/147366 | | | 11/2012 |

* cited by examiner

REFRIGERATING CYCLE APPARATUS

BACKGROUND

1. Technical Field

The present disclosure relates to a refrigerating cycle apparatus.

2. Description of the Related Art

Halogenated hydrocarbons such as chlorofluorocarbon and alternatives for chlorofluorocarbon have been widely used as refrigerants for refrigerating cycle apparatuses. However, such refrigerants may lead to destruction of the ozone layer and to global warming. To solve the problem, a refrigerating cycle apparatus that uses water, which has very small impact on the global environment, as a refrigerant has been developed.

As illustrated in FIG. 10, Japanese Patent No. 4454456 discloses a closed system refrigerating apparatus 300 that uses water as a refrigerant. The refrigerating apparatus 300 includes an evaporator 316, a condenser 318, and a connection pipe 319, and a compressor 320. The condenser 318 is coupled to the evaporator 316 through a connection pipe 317. The connection pipe 319 connects the evaporator 316 to the condenser 318. The compressor 320 is disposed on the connection pipe 319. The evaporator 316 is a shell and tube evaporator, for example, which includes a cylindrical body with multiple cooling tubes inside it. Water refrigerant is separated into liquid and vapor in the cylindrical body, and the vapor is drawn into the compressor 320. The cooling tubes are immersed in the water refrigerant. Brine or water flows through the cooling tubes. Latent heat of vaporization of the water refrigerant cools the brine or water flowing through the cooling tubes.

As illustrated in FIG. 11, International Publication No. WO2012/147366 discloses an air conditioner 500 that uses a refrigerant including water, alcohol, or ether, for example, as a main component. The air conditioner 500 includes a refrigerant circuit 502, a first circuit 504, and a second circuit 505. The refrigerant circuit 502 includes an evaporator 525, a vapor channel 502*a*, a condenser 523, and a liquid channel 502*b*. A first compressor 521 and a second compressor 522 are disposed on the vapor channel 502*a*. Ends of the first circuit 504 are connected to the evaporator 525, and ends of the second circuit 505 are connected to the condenser 523. The first circuit 504 circulates the liquid refrigerant stored in the evaporator 525 through an indoor heat exchanger 531 (first heat exchanger). The second circuit 505 circulates a liquid refrigerant stored in the condenser 523 through an outdoor heat exchanger 533 (second heat exchanger).

A first pump 540 is disposed upstream of the indoor heat exchanger 531 on the first circuit 504. A second pump 550 is disposed upstream of the outdoor heat exchanger 533 on the second circuit 505. A section between the first pump 540 and the indoor heat exchanger 531 in the first circuit 504 intersects a section between the second pump 550 and the outdoor heat exchanger 533 in the second circuit 505, and a first four-way valve 561 is disposed at the intersection. Furthermore, a section between the indoor heat exchanger 531 and the evaporator 525 in the first circuit 504 intersects a section between the outdoor heat exchanger 533 and the condenser 523 in the second circuit 505, and a second four-way valve 562 is disposed at the intersection. The air conditioner 500 is operated in either of a cooling mode and a heating mode by shifting the first four-way valve 561 and the second four-way valve 562.

SUMMARY

Japanese Patent No. 4454456 and International Publication No. WO2012/147366 do not specifically discuss how to defrost the heat exchanger on the heat absorption side in the refrigerating cycle apparatus.

One non-limiting and exemplary embodiment provides a refrigerating cycle apparatus that uses a refrigerant containing fluid whose saturated vapor pressure at ordinary temperature is a negative pressure as a main component and in which a heat loss due to defrosting is reduced.

In one general aspect, the techniques disclosed here feature a refrigerating cycle apparatus including: a first circuit that circulates a refrigerant flowing therein; a second circuit that circulates the refrigerant flowing therein; a third circuit that circulates the refrigerant flowing therein; an evaporator that is commonly disposed on the first circuit and the second circuit, that stores the refrigerant in liquid form, and that evaporates the refrigerant; a compressor that compresses the evaporated refrigerant; a condenser that is commonly disposed on the first circuit and the third circuit, that stores the refrigerant in liquid form, and that condenses the compressed refrigerant; a first heat exchanger that is disposed on the second circuit and that heats the refrigerant; a first pump that is disposed on the second circuit and that circulates the refrigerant; a second heat exchanger that is disposed on the third circuit and that cools the refrigerant; a second pump that is disposed on the third circuit and that circulates the refrigerant, wherein the refrigerant's saturated vapor pressure at ordinary temperature is a negative pressure, the second circuit include a first portion and a second portion, the second portion being positioned between the first portion and a portion where the refrigerant flows into the evaporator, the third circuit includes a third portion and a fourth portion, the fourth portion being positioned between the third portion and a portion where the refrigerant flows into the condenser, the refrigerating cycle apparatus further includes at least one selected from the group of: a first bypass channel that connects the first portion to the second portion, in the first bypass channel the refrigerant flowing from the first portion to the second portion; and a second bypass channel that connects the third portion to the fourth portion, in the second bypass channel the refrigerant flowing from the third portion to the fourth portion, a third heat exchanger that is sharedly disposed on the first bypass channel and the third circuit, on the second circuit and the second bypass channel, or on the first bypass channel and the second bypass channel, the refrigerant cycle apparatus further includes at least one selected from the group of: a first adjustment mechanism that adjusts a ratio of an amount of the refrigerant flowing in the first bypass channel to an amount of the refrigerant flowing from the first portion to the second portion in the second circuit; and a second adjustment mechanism that adjusts a ratio of an amount of the refrigerant flowing in the second bypass channel to an amount of the refrigerant flowing from the third portion to the fourth portion in the third circuit.

The refrigerating cycle apparatus of the present disclosure reduces the heat loss due to defrosting.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
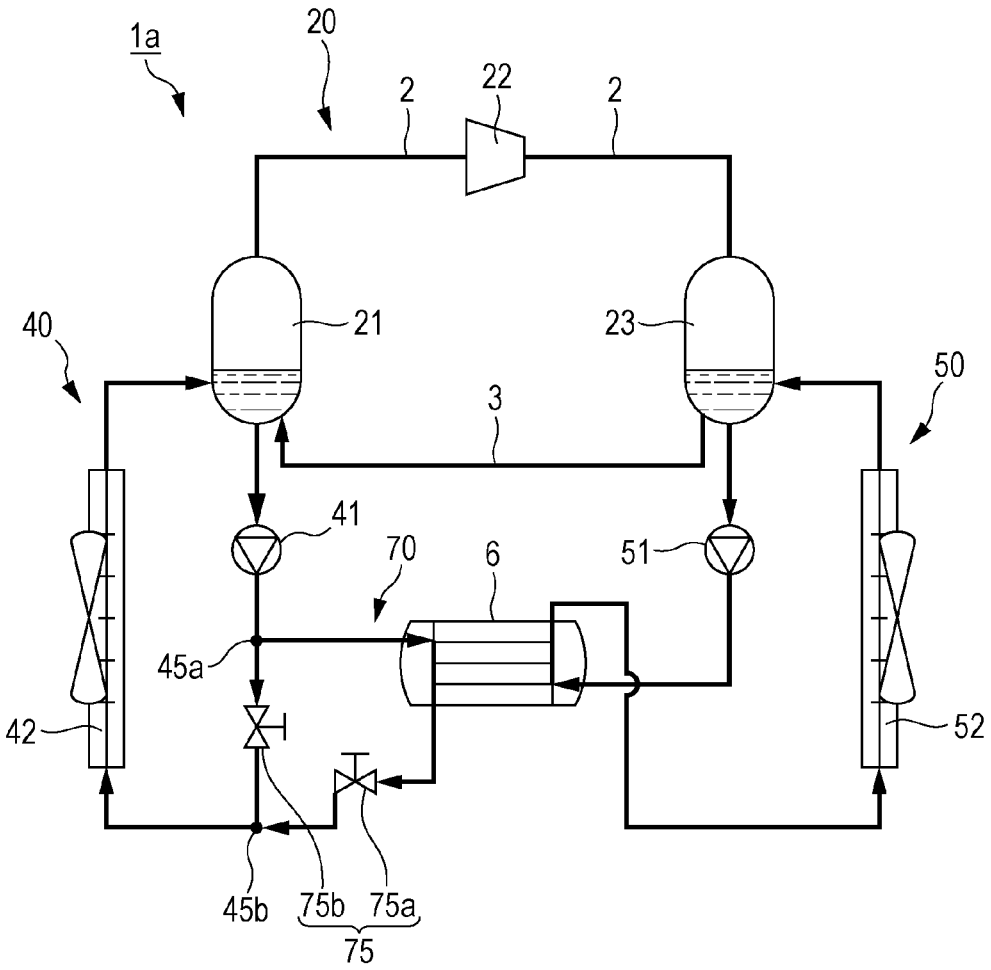
FIG. 1 is a configuration diagram of a refrigerating cycle apparatus of a first embodiment.

In some cases, a refrigerant used in a refrigerating cycle apparatus includes an additive in addition to refrigerant components. A refrigerant including water whose saturated vapor pressure at ordinary temperature (20° C.±15° C., JIS Z8703, Japanese Industrial Standard) is a negative pressure may include an additive that prevents water from freezing. The additive enables the refrigerating cycle apparatus to operate under a condition in which the temperature of the refrigerant component might fall to below zero.

An outdoor heat exchanger of an air conditioner operating in a heating mode is exposed to cold outdoor air, for example. As in this case, if a heat source for a heat absorption side of a refrigerating cycle apparatus is cold air, a heat exchanger on the heat absorption side may be frosted. The same may happen to any refrigerating cycle apparatus that uses a refrigerant containing fluid whose saturated vapor pressure at ordinary temperature is a negative pressure as a main component, because the temperature of the refrigerant component may fall to below zero in such refrigerating cycle apparatuses.

In the refrigerating apparatus 300 described in Japanese Patent No. 4454456, defrosting may be performed by operating the compressor 320 in reverse to heat the brine, which is to be supplied to the heat exchanger on the heat absorption side, to a temperature higher than that required for defrosting. Furthermore, in the air conditioner 500 described in International Publication No. WO 2012/147366, defrosting may be performed by switching the first four-way valve 561 and the second four-way valve 562 to supply a high temperature refrigerant stored in the condenser 523 to the heat exchanger on the heat absorption side. In these methods, the heat is transferred from the refrigerant or the brine, which should maintain a high temperature, to the heat exchanger on the heat absorption side in an amount far more than necessary for defrosting. Thus, a large heat loss may occur. This finding is based on the study conducted by the inventors of the present disclosure and is not based on the prior arts.

A first aspect provides a refrigerating cycle apparatus that includes: a first circuit that circulates a refrigerant flowing therein; a second circuit that circulates the refrigerant flowing therein; a third circuit that circulates the refrigerant flowing therein; an evaporator that is commonly disposed on the first circuit and the second circuit, that stores the refrigerant in liquid form, and that evaporates the refrigerant; a compressor that compresses the evaporated refrigerant; a condenser that is commonly disposed on the first circuit and the third circuit, that stores the refrigerant in liquid form, and that condenses the compressed refrigerant; a first heat exchanger that is disposed on the second circuit and that heats the refrigerant; a first pump that is disposed on the second circuit and that circulates the refrigerant; a second heat exchanger that is disposed on the third circuit and that cools the refrigerant; a second pump that is disposed on the third circuit and that circulates the refrigerant, wherein the refrigerant's saturated vapor pressure at ordinary temperature is a negative pressure, the second circuit includes a first portion and a second portion, the second portion being positioned between the first portion and a portion where the refrigerant flows into the evaporator, the third circuit includes a third portion and a fourth portion, the fourth portion being positioned between the third portion and a portion where the refrigerant flows into the condenser, the refrigerating cycle apparatus further includes at least one selected from the group of: a first bypass channel that connects the first portion to the second portion, in the first bypass channel the refrigerant flowing from the first portion to the second portion; and a second bypass channel that connects the third portion to the fourth portion, in the second bypass channel the refrigerant flowing from the third portion to the fourth portion, a third heat exchanger that is sharedly disposed on the first bypass channel and the third circuit, on the second circuit and the second bypass channel, or on the first bypass channel and the second bypass channel, the refrigerant cycle apparatus further includes at least one selected from the group of: a first adjustment mechanism that adjusts a ratio of an amount of the refrigerant flowing in the first bypass channel to an amount of the refrigerant flowing from the first portion to the second portion in the second circuit; and a second adjustment mechanism that adjusts a ratio of an amount of the refrigerant flowing in the second bypass channel to an amount of the refrigerant flowing from the third portion to the fourth portion in the third circuit.

In the refrigerating cycle apparatus of the first aspect, the refrigerant flowing in a section upstream of the inlet of the first heat exchanger (heat absorption heat exchanger) in the second circuit (heat absorption circuit) is heated in the third heat exchanger (internal heat exchanger) by the refrigerant flowing through the third circuit (heat release circuit). Then, the heated refrigerant is supplied to the first heat exchanger (heat absorption heat exchanger), and thus the first heat exchanger (heat absorption heat exchanger) is defrosted. In the refrigerating apparatus of the first aspect, the first heat exchanger (heat absorption heat exchanger) is defrosted. The refrigerating cycle apparatus further includes at least one of the first bypass channel (heat absorption bypass channel) and the second bypass channel (heat release bypass channel) and at least one of the first adjustment mechanism (flow rate adjustment mechanism for heat absorption) and the second adjustment mechanism (flow rate adjustment mechanism for heat release). With this configuration, the amount of heat applied to the refrigerant, which is supplied to the first heat exchanger (heat absorption heat exchanger), at the third heat exchanger (internal heat exchanger) is adjusted to the amount adequate for defrosting. This reduces heat loss due to defrosting.

A second aspect provides the refrigerating cycle apparatus as set forth in the first aspect, wherein the refrigerating apparatus may include the second bypass channel and the second adjustment mechanism, and the third portion may be positioned between the portion where the refrigerant flows out from the condenser and a portion where the refrigerant flows into the second heat exchanger. In the second aspect, since the refrigerant flowing through the third circuit (heat release circuit) is supplied to the third heat exchanger (internal heat exchanger) before heat release at the second heat exchanger (heat release heat exchanger), a difference in temperature between two fluids to be subjected to heat exchange in the third heat exchanger (internal heat exchanger) is large. This enables the third heat exchanger (internal heat exchanger) to have a small size.

A third aspect provides the refrigerating cycle apparatus as set forth in the second aspect, wherein the fourth portion may be positioned between a portion where the refrigerant flows out from the second heat exchanger and the portion where the refrigerant flows into the condenser. In the third aspect, the refrigerant that has passed through the third heat exchanger (internal heat exchanger) flows through the second bypass channel (bypass channel for heat release) and returns to the condenser without passing through the second heat exchanger (heat release heat exchanger). This reduces a pressure loss of the fluid flowing through the second bypass channel (bypass channel for heat release), and thus less power is required. As a result, performance of the refrigerating cycle apparatus improves.

A fourth aspect provides the refrigerating cycle apparatus as set forth in any one of the first to third aspects, wherein the refrigerating apparatus may include the second bypass channel and the second adjustment mechanism, and the third portion may be positioned between the portion where the refrigerant flows out from the second heat exchanger and the portion where the refrigerant flows into the condenser. In the fourth aspect, since the refrigerant flowing through the third circuit (heat release circuit) after heat release at the second heat exchanger (heat release heat exchanger) is supplied to the third heat exchanger (internal heat exchanger), the temperature of the fluid supplied to the second heat exchanger (heat release heat exchanger) is maintained high during defrosting. Thus, the second heat exchanger (heat release heat exchanger) maintains its performance even if defrosting is performed.

A fifth aspect provides the refrigerating cycle apparatus as set forth in any one of the first to fourth aspects, wherein the first pump may be positioned between the portion where the refrigerant flows out from the evaporator and a portion where the refrigerant flows into the first heat exchanger, the second circuit may include a fifth portion and a sixth portion, the fifth portion being positioned between the portion where the refrigerant flows out from the evaporator and a portion where the refrigerant flows into the first pump, the sixth portion being positioned between a portion where the refrigerant flows out from the first heat exchanger and the portion where the refrigerant flows into the evaporator, and the refrigerating apparatus may further include: a third bypass channel that connects the fifth portion to the sixth portion, in the third bypass channel the refrigerant flowing from the fifth portion to the sixth portion; and a third adjustment mechanism that adjusts a ratio of an amount of the refrigerant flowing in the third bypass channel to an amount of the refrigerant flowing from the fifth portion to the sixth portion in the second circuit.

In the fifth aspect, for the defrosting operation, the fluid that has passed through the first heat exchanger (heat absorption heat exchanger) is supplied to the second circuit (heat absorption circuit) at a position upstream of the inlet of the first pump (first fluid movement device) since the evaporator is bypassed by the third bypass channel (evaporator bypass channel). With this configuration, the fluid that has passed through the first heat exchanger (heat absorption heat exchanger) does not increase the temperature of the refrigerant in the evaporator during the defrosting. In addition, the fluid that has been used for the defrosting operation maintains a relatively high temperature and is supplied again to the second circuit (heat absorption circuit) at the position upstream of the inlet of the first fluid movement device. Thus, the heat loss due to the defrosting operation is reduced, and thus the duration of the defrosting operation is shortened. In addition, the refrigerating cycle apparatus is able to operate in the normal operation mode shortly after the defrosting operation.

A sixth aspect provides the refrigerating cycle apparatus as set forth in any one of the first to fifth aspects, wherein the refrigerating apparatus may include the first bypass channel, the first adjustment mechanism, the second bypass channel, and the second adjustment mechanism. In the sixth aspect, when the defrosting is not performed, the fluid in the second circuit (heat absorption circuit) is supplied to the first heat exchanger (heat absorption heat exchanger) without passing through the third heat exchanger (internal heat exchanger), and the fluid in the third circuit (heat release circuit) returns to the condenser without passing through the third heat exchanger (internal heat exchanger). This reduces pressure loss of the flow of the fluid in the second circuit (heat absorption circuit) and pressure loss of the flow of the fluid in the third circuit (heat release circuit) when the defrosting operation is not performed, and thus less power is required to be applied to the first pump (first fluid movement device) and the second pump (second fluid movement device). As a result, the performance of the refrigerating cycle apparatus improves.

A seventh aspect provides the refrigerating cycle apparatus as set forth in any one of the first to sixth aspects, wherein the refrigerating apparatus may further include an ejector that is sharedly disposed on the first circuit and the third circuit, that sucks the compressed vapor refrigerant flowing in the first circuit by using flow of the refrigerant in liquid form flowing in the third circuit as driving flow. In the seventh aspect, the refrigerant in liquid form as driving flow is sprayed by the ejector and the refrigerant in the form of spray comes in contact with the vapor refrigerant compressed by the compressor. The ejector exhibits high condensation performance. This enables the condenser to have a small size.

An eighth aspect provides a refrigerating cycle apparatus that includes a first circuit that circulates a refrigerant flowing therein; a second circuit that circulates a first heat transfer medium flowing therein; a third circuit that circulates a second heat transfer medium flowing therein; an evaporator that is commonly disposed on the first circuit and the second circuit, that transfers heat of the first heat transfer medium to the refrigerant, and that evaporates the refrigerant; a compressor that compresses the evaporated refrigerant; a condenser that is commonly disposed on the first circuit and the third circuit, that transfers heat of the refrigerant to the second heat transfer medium, and that condenses the compressed refrigerant; a first heat exchanger that is disposed on the second circuit and that heats the first heat transfer medium; a first pump that is disposed on the second circuit and that circulates the first heat transfer medium; a second heat exchanger that is disposed on the third circuit and that cools the second heat transfer medium; a second pump that is disposed on the third circuit and that circulates the second heat transfer medium, wherein the refrigerant's saturated vapor pressure at ordinary temperature is a negative pressure, the second circuit includes a first portion and a second portion, the second portion being positioned between the first portion and a portion where the first heat transfer medium flows into the evaporator, the third circuit includes a third portion and a fourth portion, the fourth portion being positioned between the third portion and a portion where the second heat transfer medium flows into the condenser, the refrigerating cycle apparatus further includes at least one selected from the group of: a first bypass channel that connects the first portion to the second portion, in the first bypass channel the first heat transfer medium flowing from the first portion to the second portion; and a second bypass channel that connects the third portion to the fourth portion, in the second bypass channel the second heat transfer medium flowing from the third portion to the fourth portion, a third heat exchanger that is sharedly disposed on the first bypass channel and the third circuit, on the second circuit and the second bypass channel, or on the first bypass channel and the second bypass channel, the refrigerant cycle apparatus further includes at least one selected from the group of: a first adjustment mechanism that adjusts a ratio of an amount of the first heat transfer medium flowing in the first bypass channel to an amount of the first heat transfer medium flowing from the first portion to the second portion in the second circuit; and a second adjustment mechanism that adjusts a ratio of an amount of the second heat transfer medium flowing in the second bypass channel to an amount of the second heat transfer medium flowing from the third portion to the fourth portion in the third circuit. The eight aspect provides the same advantages as those in the first aspect.

A ninth aspect provides the refrigerating cycle apparatus as set forth in the eighth aspect, wherein the refrigerating apparatus may include the second bypass channel and the second adjustment mechanism, and the third portion may be positioned between the portion where the second heat transfer medium flows out from the condenser and a portion where the second heat transfer medium flows into the second heat exchanger. The ninth aspect provides the same advantages as those in the second aspect.

A tenth aspect provides the refrigerating cycle apparatus as set forth in the ninth aspect, wherein the fourth portion may be positioned between a portion where the second heat transfer medium flows out from the second heat exchanger and the portion where the second heat transfer medium flows into the condenser. The tenth aspect provides the same advantages as those in the third aspect.

An eleventh aspect provides the refrigerating cycle apparatus as set forth in any one of the eighth to tenth aspects, wherein the refrigerating apparatus may include the second bypass channel and the second adjustment mechanism, and the third portion may be positioned between the portion where the second heat transfer medium flows out from the second heat exchanger and the portion where the second heat transfer medium flows into the condenser. The eleventh aspect provides the same advantages as those in the fourth aspect.

A twelfth aspect provides the refrigerating cycle apparatus as set forth in any one of the eighth to eleventh aspects, wherein the first pump may be positioned between the portion where the first heat transfer medium flows out from the evaporator and a portion where the first heat transfer medium flows into the first heat exchanger, the second circuit may include a fifth portion and a sixth portion, the fifth portion being positioned between the portion where the first heat transfer medium flows out from the evaporator and a portion the first heat transfer medium flows into the first pump, the sixth portion being positioned between a portion where the first heat transfer medium flows out from the first heat exchanger and the portion where the first heat transfer medium flows into the evaporator, and the refrigerating apparatus may further include: a third bypass channel that connects the fifth portion to the sixth portion, in the third bypass channel the first heat transfer medium flowing from the fifth portion to the sixth portion; and a third adjustment mechanism that adjusts a ratio of an amount of the first heat transfer medium flowing in the third bypass channel to an amount of the first heat transfer medium flowing from the fifth portion to the sixth portion in the second circuit. The twelfth aspect provides the same advantages as those in the fifth aspect.

A thirteenth aspect provides the refrigerating cycle apparatus as set forth in any one of the eighth to twelfth aspects, wherein the refrigerating apparatus may include the first bypass channel, the first adjustment mechanism, the second bypass channel, and the second adjustment mechanism. The thirteenth aspect provides the same advantages as those in the sixth aspect.

A fourteenth aspect provides the refrigerating cycle apparatus that includes a first circuit that circulates a refrigerant flowing therein; an evaporator that is disposed on the first circuit, that stores the refrigerant in liquid form, and that evaporates the refrigerant; a compressor that compresses the evaporated refrigerant; a condenser that is disposed on the first circuit, that stores the refrigerant in liquid form, and that condenses the compressed refrigerant; a first four-way valve; a second four-way valve; a first channel that connects a portion of the evaporator to a part of the first four-way valve; a second channel that connects a part of the first four-way valve to a part of the second four-way valve; a third channel that connects a part of the second four-way valve to a part of the first circuit; a fourth channel that connects a part of the condenser to a part of the first four-way valve; a fifth channel that connects a part of the first four-way valve to a part of the second four-way valve; a sixth channel that connects a part of the second four-way valve to a part of the condenser; a seventh channel that connects a part of the fourth channel to a part of the condenser; a first heat exchanger that is disposed on the second channel; a second heat exchanger that is disposed on the fifth channel; a third heat exchanger that is sharedly disposed on the first channel and the seventh channel; an adjustment mechanism that adjusts a ratio of an amount of the refrigerant flowing in the sixth channel to an amount of the refrigerant flowing in the seventh channel, wherein the refrigerant's saturated vapor pressure at ordinary temperature is a negative pressure, when the refrigerating apparatus is in a first state, the first four-way valve connects the first channel to the second channel, and the fourth channel to the fifth channel, and the second four-way valve connects the third channel to the second channel, and the fifth channel to the sixth channel, and when the refrigerating apparatus is in a second state, the first four-way valve connects the first channel to the fifth channel, the second channel to the fourth channel, and the second four-way valve connects the third channel to the fifth channel, and the second channel to the sixth channel.

In the fourteenth aspect, switching between the first state and the second state is performed by the first four-way valve and the second four-way valve (switching mechanism). The refrigerant stored in the evaporator is supplied selectivity to the first heat exchanger or the second heat exchanger, and the refrigerant stored in the condenser is supplied selectivity to the first heat exchanger and the second heat exchanger, as necessary. In addition, the defrosting operation is able to be performed without switching between the first state and the second state.

Hereinafter, embodiments of the present disclosure are described with reference to the drawings. The embodiments in the following description are merely examples of the present disclosure, and the present disclosure should not be limited thereto.

First Embodiment

As illustrated in FIG. 1, a refrigerating cycle apparatus 1*a* includes a main circuit 20 (first circuit), a heat absorption circuit 40 (second circuit), a heat release circuit 50 (third circuit), an internal heat exchanger 6 (third heat exchanger), a heat absorption bypass channel 70 (first bypass channel), and a flow rate adjustment mechanism for heat absorption 75 (first adjustment mechanism). The main circuit 20 includes an evaporator 21, a compressor 22, a condenser 23, and a feeding channel 3. A refrigerant circulates in the main circuit 20 through the evaporator 21, the compressor 22, and the condenser 23 in this order. The main circuit 20 is filled with the refrigerant and the inside of the main circuit 20 is at a negative pressure, which is lower than the atmospheric pressure. The refrigerant includes fluid such as water and alcohol, whose saturated vapor pressure at ordinary temperature is a negative pressure, as a main component. Herein, the "main component" is a component that is present in the refrigerant in the largest amount by weight. The refrigerant may include another component such as an antifreezing agent. Herein, "flow rate" refers to "mass flow rate" unless otherwise specified. In FIG. 1, arrows indicate a flow direction of the fluid. The refrigerating cycle apparatus 1*a* constitutes an air conditioner, for example.

The evaporator 21 stores the refrigerant and allows the refrigerant to evaporate. The evaporator 21 includes a heat-resistant and pressure-resistant hollow container, for example. The evaporator 21 stores the refrigerant in the form of liquid therein. The liquid refrigerant in the evaporator 21 is evaporated to be in the form of vapor. The evaporator 21 is connected to an inlet of the compressor 22 through a pipe constituting the vapor channel 2. The vapor refrigerant generated in the evaporator 21 is drawn into the compressor 22. The compressor 22 compresses the vapor refrigerant drawn from the evaporator 21. The compressor 22 is an axial turbo compressor or a centrifugal turbo compressor, for example. An outlet of the compressor 22 is connected to the condenser 23 through a pipe constituting the vapor channel 2. The condenser 23 condenses the vapor refrigerant compressed by the compressor 22 and stores the refrigerant. The condenser 23 includes a heat-resistant and pressure-resistant hollow container, for example. The condenser 23 stores the liquid refrigerant therein. The feeding channel 3 is connected to the condenser 23 at one end and to the evaporator 21 at the other end. The liquid refrigerant stored in the condenser 23 is supplied to the evaporator 21 through the feeding channel 3. In other words, the feeding channel 3 is a channel through which the liquid refrigerant flows from the condenser 23 to the evaporator 21.

The heat absorption circuit 40 includes a first fluid movement device 41 (first pump) and a heat absorption heat exchanger 42 (first heat exchanger). The heat absorption circuit 40 is connected to the evaporator 21 such that the refrigerant stored in the evaporator 21 or a heat absorption heat transfer medium (first heat transfer medium) that has been subjected to indirect heat exchange with the refrigerant stored in the evaporator 21 returns to the evaporator 21 after being supplied to the heat absorption heat exchanger 42. The first fluid movement device 41 forces the fluid to flow in the heat absorption circuit 40 such that the fluid returns to the evaporator 21 after being supplied to the heat absorption heat exchanger 42. The first fluid movement device 41 is positioned upstream of the inlet of the heat absorption heat exchanger 42 in the flow direction of the fluid in the heat absorption circuit 40. The first fluid movement device 41 may be positioned downstream of the heat absorption heat exchanger 42 in the flow direction of the fluid. The heat absorption heat exchanger 42 is a fin tube heat exchanger that transfers heat between the fluid flowing in the heat absorption circuit 40 and air outside, for example. In the heat absorption heat exchanger 42, the fluid flowing in the heat absorption circuit 40 absorbs the heat through heat exchange with the air outside, for example. The heated fluid returns to the evaporator 21 and allows the liquid refrigerant stored in the evaporator 21 to evaporate. Latent heat of evaporation of the liquid refrigerant in the evaporator 21 cools the liquid refrigerant.

The evaporator 21 is a direct contact type heat exchanger, for example, in which the fluid circulating in the main circuit 20 and the fluid circulating in the heat absorption circuit 40 directly contact with each other. The heat absorption circuit 40 is connected to the evaporator 21 such that the refrigerant stored in the evaporator 21 returns to the evaporator 21 after being supplied to the heat absorption heat exchanger 42. In this case, heat loss is small in the evaporator 21, which enables the evaporator 21 to have a small size.

The evaporator 21 may be an indirect contact type heat exchanger in which the fluid circulating in the main circuit 20 and the fluid circulating in the heat absorption circuit 40 indirectly contact with each other with a wall being disposed therebetween. In such a case, the heat absorption circuit 40 is connected to the evaporator 21 such that the heat absorption heat transfer medium that has been subjected to indirect heat exchange with the refrigerant in the evaporator 21 returns to the evaporator 21 after being supplied to the heat absorption heat exchanger 42. In this case, the heat absorption heat transfer medium and the refrigerant are able to have different characteristics. The heat absorption heat transfer medium is able to have preferable characteristics as the fluid flowing in the heat absorption circuit 40 and the refrigerant is able to have preferable characteristics as the fluid flowing in the main circuit 20. The indirect contact type heat exchanger may be a shell and tube heat exchanger. In such a case, the evaporator 21 includes a shell and tubes. A space for storing the refrigerant is defined by an inner surface of the shell and outer surfaces of the tubes. The tubes provide channels for the heat absorption heat transfer medium which is the fluid circulating in the heat absorption circuit 40. At least a portion of the tubes is immersed in the liquid refrigerant stored in the evaporator 21. When the heat absorption heat medium flows through the tubes, heat exchange occurs between the heat absorption heat medium and the liquid refrigerant stored in the evaporator 21. First and second ends of each tube are connected to corresponding first and second ends of the heat absorption circuit 40, for example, such that the heat absorption circuit 40 is connected to the evaporator 21.

The heat release circuit 50 includes a second fluid movement device 51 (second pump) and a heat release heat exchanger 52 (second heat exchanger). The heat release circuit 50 is connected to the condenser 23 such that the refrigerant stored in the condenser 23 or the heat release heat transfer medium (second heat transfer medium) that has been subjected to indirect heat exchange with the refrigerant in the condenser 23 returns to the condenser 23 after being supplied to the heat release heat exchanger 52. The second fluid movement device 51 forces the fluid to flow in the heat release circuit 50 such that the fluid returns to the condenser 23 after being supplied to the heat release heat exchanger 52. The second fluid movement device 51 is positioned upstream of the inlet of the heat release heat exchanger 52 in the flow direction of the fluid in the heat release circuit 50. The second fluid movement device 51 may be positioned downstream of the outlet of the heat release heat exchanger 52 in the flow direction of the fluid. The heat release heat exchanger 52 may be a fin and tube type heat exchanger that transfers heat between the fluid flowing in the heat release circuit 50 and air outside, for example. In the heat release heat exchanger 52, heat of the fluid flowing in the heat release circuit 50 is released through the heat exchange with the air outside, for example. The cooled fluid returns to the condenser 23 and cools the vapor refrigerant in the condenser 23, which is supplied from the compressor 22, to condense.

The condenser 23 is a direct contact type heat exchanger, for example, in which the fluid circulating in the main circuit 20 and the liquid circulating in the heat release circuit 50 are in directly contact with each other. In such a case, the heat release circuit 50 is connected to the condenser 23 such that the refrigerant stored in the condenser 23 returns to the condenser 23 after being supplied to the heat release heat exchanger 52. In this case, heat loss is small in the condenser 23, which enables the condenser 23 to have a small size.

The condenser 23 may be an indirect contact type heat exchanger in which the fluid circulating in the main circuit 20 and the fluid circulating in the heat release circuit 50 are in indirectly contact with each other with a wall being disposed therebetween. In such a case, the heat release circuit 50 is connected to the condenser 23 such that the heat absorption heat transfer medium that has been subjected to indirect heat exchange with the refrigerant in the condenser 23 returns to the condenser 23 after being supplied to the heat release heat exchanger 52. In this case, the heat release heat transfer medium and the refrigerant are able to have different characteristics. The heat release heat transfer medium is able to have preferable characteristics as the fluid flowing in the heat release circuit 50 and the refrigerant is able to have preferable characteristics as the fluid flowing in the main circuit 20. The indirect contact type heat exchanger may be a shell and tube heat exchanger. In such a case, the condenser 23 includes a shell and tubes. A space for storing the refrigerant is defined between an inner surface of the shell and outer surfaces of the tube. The tubes provide channels for the heat release heat transfer medium which is the fluid circulating in the heat release circuit 50. At least a portion of the tubes is immersed in the liquid refrigerant stored in the condenser 23. When the heat release heat medium flows through the tubes, the heat exchange occurs between the heat release transfer medium and the liquid refrigerant stored in the condenser 23. First and second ends of each tube are connected to corresponding first and second ends of the heat release circuit 50, for example, such that the heat release circuit 50 is connected to the condenser 23.

The internal heat exchanger 6 is a heat exchanger that allows indirect heat exchange between at least a portion of the refrigerant or the heat absorption heat transfer medium, which flows in a section upstream of the inlet of the heat absorption heat exchanger 42 in the heat absorption circuit 40, and at least a portion of the refrigerant or the heat release heat transfer medium, which flows in the heat release circuit 50. The internal heat exchanger 6 may be any indirect contact type heat exchanger such as a plate heat exchanger and a double pipe heat exchanger. The internal heat exchanger 6 is disposed on the heat absorption bypass channel 70 and the heat release circuit 50.

The heat absorption bypass channel 70 diverges from the heat absorption circuit 40 at a diverging position 45*a* positioned upstream of the heat absorption heat exchanger 42 and extends through the internal heat exchanger 6 to a converging position 45*b*, which is positioned between the diverging position 45*a* and the inlet of the heat absorption heat exchanger 42 in the heat absorption circuit 40. With this configuration, in the heat absorption circuit 40, the refrigerant or the heat absorption heat transfer medium that has passed through the internal heat exchanger 6 is supplied to the heat absorption heat exchanger 42. The diverging position 45*a* is positioned downstream of the outlet of the first fluid movement device 41 in the heat absorption circuit 40. The heat release circuit 50 extends through the internal heat exchanger 6. The internal heat exchanger 6 is positioned between the outlet of the second fluid movement device 51 and the inlet of the heat release heat exchanger 52 in the heat release circuit 50.

The flow rate adjustment mechanism for heat absorption 75 adjusts a flow rate of the refrigerant or the heat absorption heat transfer medium flowing through the heat absorption bypass channel 70 and a flow rate of the refrigerant or the heat absorption heat transfer medium flowing between the diverging position 45*a* and the converging position 45*b* in the heat absorption circuit 40. The flow rate adjustment mechanism for heat absorption 75 includes a heat absorption bypass valve 75*a* and a heat absorption mainstream valve 75*b*, for example. The heat absorption bypass valve 75*a* is disposed on the heat absorption bypass channel 70. The heat absorption mainstream valve 75*b* is disposed between the diverging position 45*a* and the converging position 45*b* in the heat absorption circuit 40. The heat absorption bypass valve 75*a* and the heat absorption mainstream valve 75*b* each may be a gate valve such as a magnet valve or a flow regulating valve such as an electric-operated valve, in which the opening degree thereof is adjustable. A controller (not illustrated) such as a DSP (Digital Signal Processor) controls opening and closing of the heat absorption bypass valve 75*a* or the opening degree of the heat absorption bypass valve 75*a* and controls opening and closing of the heat absorption mainstream valve 75*b* or the opening degree of the heat absorption mainstream valve 75*b*. Thus, the flow rate of the fluid flowing in the heat absorption bypass channel 70 is adjusted. If one of the heat absorption bypass valve 75*a* and the heat absorption mainstream valve 75*b* is the flow regulating valve, the other one of them may be an orifice. In addition, the flow rate adjustment mechanism for heat absorption 75 may include a three-way valve at the diverging position 45*a*. In such a case, the heat absorption bypass valve 75*a* and the heat absorption mainstream valve 75*b* are optional components. The three-way valve of the flow rate adjustment mechanism for heat absorption 75 may be an electric three-way valve, for example.

Operation of the refrigerating cycle apparatus 1*a* is described. When the refrigerating cycle apparatus 1*a* is in a normal operation mode, the flow rate adjustment mechanism for heat absorption 75 controls a flow rate of the fluid flowing through the heat absorption bypass channel 70 to be zero or as small as possible. The heat absorption bypass valve 75*a* is closed or the opening degree of the heat absorption bypass valve 75*a* is controlled to be as small as possible, for example, and the heat absorption mainstream valve 75*b* is opened or the opening degree of the heat absorption mainstream valve 75*b* is controlled to be a predetermined degree, for example. As a result, almost no heat exchange occurs in the internal heat exchanger 6, and the fluid having a relatively low temperature is supplied to the heat absorption heat exchanger 42.

If the heat absorption heat exchanger 42 is exposed to cold outside air, the heat absorption heat exchanger 42 becomes frosted. This degrades the performance (amount of heat exchange) of the heat absorption heat exchanger 42. If the performance of the heat absorption heat exchanger 42 is degraded to a level lower than a predetermined level due to the frost, the operation mode of the refrigerating cycle apparatus 1*a* is shifted from the normal operation mode to a defrosting operation mode in order to recover the performance of the heat absorption heat exchanger 42. The performance of the heat absorption heat exchanger 42 is calculated based on the temperature of the fluid at the inlet of the heat absorption heat exchanger 42, the temperature of the fluid at the outlet of the heat absorption heat exchanger 42, and the amount of the fluid sent by the first fluid movement device 41, for example. The operation mode of the refrigerating cycle apparatus 1*a* is shifted from the normal operation mode to the defrosting operation mode when the calculated performance of the heat absorption heat exchanger 42 is lower than a predetermined threshold value.

For the defrosting operation of the refrigerating cycle apparatus 1*a*, the flow rate adjustment mechanism for heat absorption 75 is controlled such that the flow rate of the fluid flowing through the heat absorption bypass channel 70 is large compared with that in the normal operation and such that the flow rate of the fluid flowing between the diverging position 45*a* and the converging position 45*b* of the heat absorption circuit 40 is small compared with that in the normal operation. The heat absorption bypass valve 75*a* is opened or the opening degree of the heat absorption bypass valve 75*a* is controlled to be large, for example, and the heat absorption mainstream valve 75*b* is closed or the opening degree of the heat absorption mainstream valve 75*b* is controlled to be small, for example. Thus, the heat exchange occurs at the internal heat exchanger 6, and the fluid flowing through the heat absorption bypass channel 70 is heated by the fluid flowing through the heat release circuit 50. Therefore, the fluid having a relatively high temperature is supplied to the heat absorption heat exchanger 42 and the frost on the heat absorption heat exchanger 42 disappears. In other words, the heat absorption heat exchanger 42 becomes defrosted. As a result, the degraded performance of the heat absorption heat exchanger 42 recovers. If the performance of the heat absorption heat exchanger 42 is determined to be higher than the predetermined threshold value by the above-described method, the defrosting operation is terminated and the mode of the refrigerating cycle apparatus 1*a* is shifted to the normal operation mode. Alternatively, the mode of the refrigerating cycle apparatus 1*a* may be shifted automatically to the normal operation mode after a predetermined duration of the defrosting operation. In such a case, the duration of the defrosting operation of the refrigerating cycle apparatus 1*a* is suitably determined based on operational conditions of the refrigerating cycle apparatus 1*a* such as the amount of heat exchange in the internal heat exchanger 6.

When the refrigerating cycle apparatus 1*a* performs the defrosting operation, the flow rate adjustment mechanism for heat absorption 75 adjusts the flow rate of the fluid flowing through the heat absorption bypass channel 70, and thus the amount of heat applied to the fluid, which is to be supplied to the heat absorption heat exchanger 42, at the internal heat exchanger 6 is adjusted. The amount of heat exchange in the internal heat exchanger 6 is adjusted to the amount adequate for defrosting of the heat absorption heat exchanger 42. This reduces heat loss due to defrosting of the heat absorption heat exchanger 42.

In the refrigerating cycle apparatus 1*a*, the heat absorption circuit 40 and the heat release circuit 50 are independent from each other. In other words, the refrigerating cycle apparatus 1*a* includes a channel that functions only as the heat absorption circuit 40 and another channel that functions only as the heat release circuit 50. This prevents the fluid flowing through the heat absorption circuit 40 from mixing with the fluid flowing through the heat release circuit 50. This enables fluids having different characteristics to circulate in the heat absorption circuit 40 and the heat release circuit 50. The fluid circulating in the heat absorption circuit 40 may include an antifreezing agent in a relatively high concentration, since the temperature of the fluid circulating therein is relatively low. The fluid circulating in the heat release circuit 50 may include an antifreezing agent in a relatively low concentration so as to have low viscosity or does not include an antifreezing agent. This reduces the amount of power required to circulate the fluid in the heat release circuit 50.

When the defrosting is not performed, the fluid is supplied to the heat absorption heat exchanger 42 by the flow rate adjustment mechanism for heat absorption 75 without passing through the internal heat exchanger 6 in the heat absorption circuit 40. This reduces pressure loss of the flow of the fluid in the heat absorption circuit 40, and thus less power is required to be applied to the first fluid movement device 41. As a result, the performance of the refrigerating cycle apparatus 1*a* improves.

Modifications

Various modifications may be added to the refrigerating cycle apparatus 1*a*. The refrigerating cycle apparatus 1*a* may include a chiller or an electricity storage system, for example. The fluid flowing through the heat absorption circuit 40 may be subjected to heat exchange with a gas other than air in the heat absorption heat exchanger 42. The fluid flowing through the heat release circuit 50 may be subjected to heat exchange with a gas other than air or a liquid in the heat release heat exchanger 52.

Second Embodiment

A refrigerating cycle apparatus 1*b* of a second embodiment is described. The components of the refrigerating cycle apparatus 1*b* that are not described have the same configurations as those of the refrigerating cycle apparatus 1*a*. The components of the refrigerating cycle apparatus 1*b* that are the same as or corresponding to those of the refrigerating cycle apparatus 1*a* are assigned the same reference numerals as those of the refrigerating cycle apparatus 1*a*, and detailed description thereof is omitted. The description regarding the first embodiment is applicable to the second embodiment if no technical contradiction occurs. The description regarding the first embodiment is also applicable to third to sixth embodiments, which are described later, if no technical contraction occurs.

Figure 2:
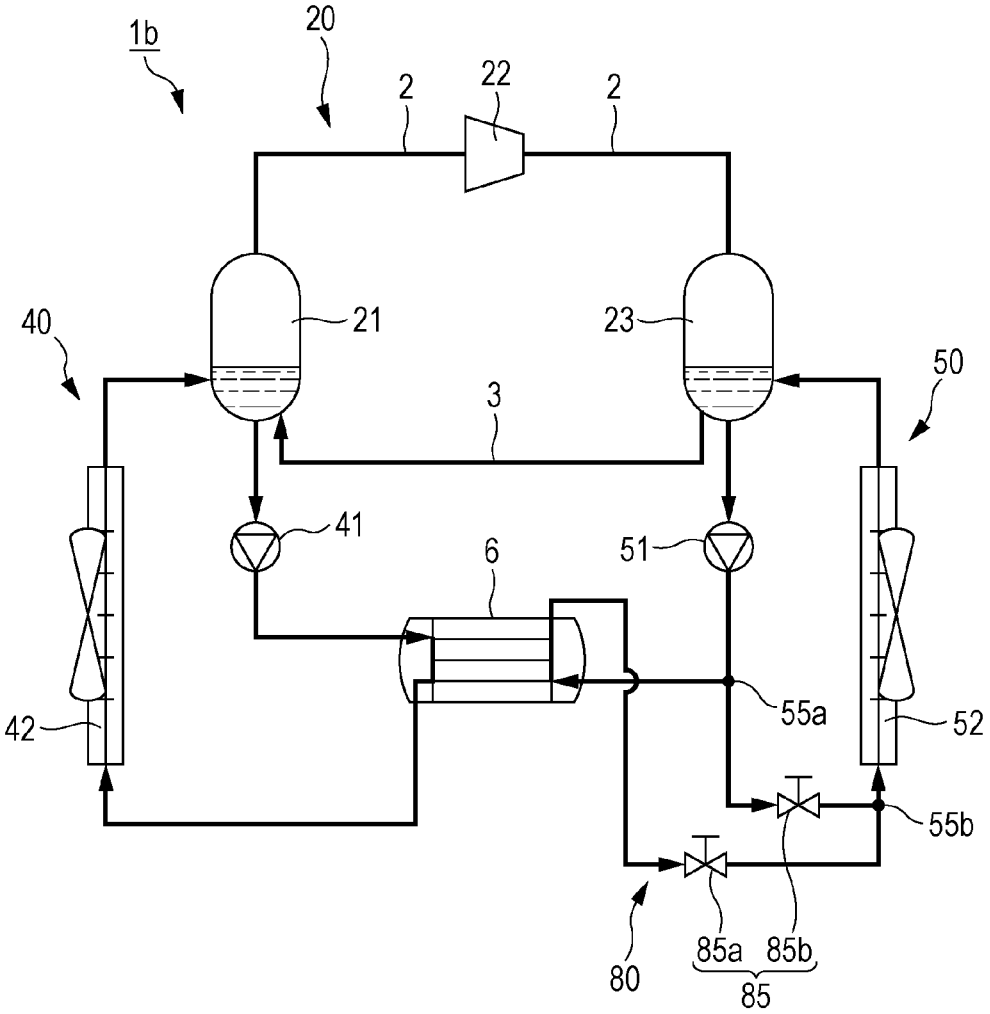
FIG. 2 is a configuration diagram of a refrigerating cycle apparatus of a second embodiment.

As illustrated in FIG. 2, the refrigerating cycle apparatus 1*b* does not include the heat absorption bypass channel 70 and the flow rate adjustment mechanism for heat absorption 75, which are included in the refrigerating cycle apparatus 1*a*. Instead, the heat absorption circuit 40 extends through the internal heat exchanger 6. The internal heat exchanger 6 is positioned between the outlet of the first fluid movement device 41 and the inlet of the heat absorption heat exchanger 42 in the heat absorption circuit 40. With this configuration, in the heat absorption circuit 40, the refrigerant or the heat absorption heat transfer medium that has passed through the internal heat exchanger 6 is supplied to the heat absorption heat exchanger 42.

The refrigerating cycle apparatus 1*b* includes a heat release bypass channel 80 and a flow rate adjustment mechanism for heat release 85 (second adjustment mechanism). The heat release bypass channel 80 (second bypass channel) diverges from the heat release circuit 50 and extends through the internal heat exchanger 6. The heat release bypass channel 80 diverges from the heat release circuit 50 at a diverging position 55*a* positioned upstream of the inlet of the heat release heat exchanger 52. The heat release bypass channel 80 enables the refrigerant or the heat release heat transfer medium flowing in a section upstream of the inlet of the heat release heat exchanger 52 in the heat release circuit 50 to be supplied to the internal heat exchanger 6. When the refrigerating cycle apparatus 1*b* performs the defrosting operation, the refrigerant or the heat release heat transfer medium circulating in the heat release circuit 50 is supplied to the internal heat exchanger 6 before heat release at the heat release heat exchanger 52. Thus, a difference in temperature between two fluids, which are subjected to heat exchange at the internal heat exchanger 6, is large. This enables the internal heat exchanger 6 to have a smaller size or shortens the duration of the defrosting operation performed by the refrigerating cycle apparatus 1*b*. The heat release bypass channel 80 extends from the diverging position 55*a* to a converging position 55*b* in the heat release circuit 50, which is positioned downstream of the diverging position 55*a*, through the internal heat exchanger 6.

The flow rate adjustment mechanism for heat release 85 adjusts a flow rate of the refrigerant or the heat release heat transfer medium flowing through the heat release bypass channel 80 and a flow rate of the refrigerant or the heat release heat transfer medium flowing through a section downstream of a position from which the heat release bypass channel 80 diverges (diverging position 55*a*) in the heat release circuit 50. The flow rate adjustment mechanism for heat release 85 includes a heat release bypass valve 85*a* and a heat release mainstream valve 85*b*, for example. The heat release bypass valve 85*a* is disposed on the heat release bypass channel 80. The heat release mainstream valve 85*b* is disposed between the diverging position 55*a* and the converging position 55*b* in the heat release circuit 50. The heat release bypass valve 85*a* and the heat release mainstream valve 85*b* each may be a gate valve such as a magnet valve or a flow regulating valve such as an electric-operated valve, in which the opening degree thereof is adjustable. A controller (not illustrated) such as a DSP (Digital Signal Processor) controls opening and closing of the heat release bypass valve 85*a* or the opening degree of the heat release bypass valve 85*a* and controls opening and closing of the heat release mainstream valve 85*b* or the opening degree of the heat release mainstream valve 85*b*. Thus, the flow rate of the fluid flowing through the heat release bypass channel 80 is adjusted. If one of the heat release bypass valve 85*a* and the heat release mainstream valve 85*b* is the flow regulating valve, the other one of them may be an orifice. In addition, the flow rate adjustment mechanism for heat release 85 may include a three-way valve at the diverging position 55*a*. In such a case, the heat release bypass valve 85*a* and the heat release mainstream valve 85*b* are optional components. The three-way valve of the flow rate adjustment mechanism for heat release 85 may be an electric three-way valve, for example.

When the refrigerating cycle apparatus 1*b* is in normal operation, the flow rate adjustment mechanism for heat release 85 controls a flow rate of the fluid flowing through the heat release bypass channel 80 to be zero or as small as possible. The heat release bypass valve 85*a* is closed or the opening degree of the heat release bypass valve 85*a* is controlled to be as small as possible, for example, and the heat release mainstream valve 85*b* is opened or the opening degree of the heat release bypass mainstream valve 85*b* is controlled to be a predetermined degree, for example. As a result, almost no heat exchange occurs in the internal heat exchanger 6, and the fluid having a relatively low temperature is supplied to the heat absorption heat exchanger 42.

For the defrosting operation of the refrigerating cycle apparatus 1*b*, the flow rate adjustment mechanism for heat release 85 is controlled such that the flow rate of the fluid flowing through the heat release bypass channel 80 is large compared to that in the normal operation and such that the flow rate of the fluid flowing through the section downstream of the diverging position 55*a* in the heat release circuit 50 is small compared to that in the normal operation. The heat release bypass valve 85*a* is opened or the opening degree of the heat release bypass valve 85*a* is controlled to be large, for example, and the heat release mainstream valve 85*b* is closed or the opening degree of the heat release mainstream valve 85*b* is controlled to be small, for example. Thus, the heat exchange occurs at the internal heat exchanger 6, and the fluid flowing through the heat absorption bypass channel 40 is heated by the fluid flowing through the heat release bypass channel 80. Therefore, the fluid having a relatively high temperature is supplied to the heat absorption heat exchanger 42, and the heat absorption heat exchanger 42 is defrosted.

When the refrigerating cycle apparatus 1*b* performs the defrosting operation, the flow rate adjustment mechanism for heat release 85 adjusts the flow rate of the fluid flowing through the heat release bypass channel 80, and thus the amount of heat applied to the fluid, which is to be supplied to the heat absorption heat exchanger 42, at the internal heat exchanger 6 is adjusted. The amount of heat exchange in the internal heat exchanger 6 is adjusted to the amount adequate for defrosting of the heat absorption heat exchanger 42. This reduces heat loss due to defrosting of the heat absorption heat exchanger 42. When the defrosting is not performed, the fluid is returned to the condenser 23 by the flow rate adjustment mechanism for heat release 85 without passing through the internal heat exchanger 6 in the heat release circuit 50. This reduces pressure loss of the flow of the fluid in the heat release circuit 50, and thus less power is required. As a result, the performance of the refrigerating cycle apparatus 1*b* improves.

Modifications

Figure 3:
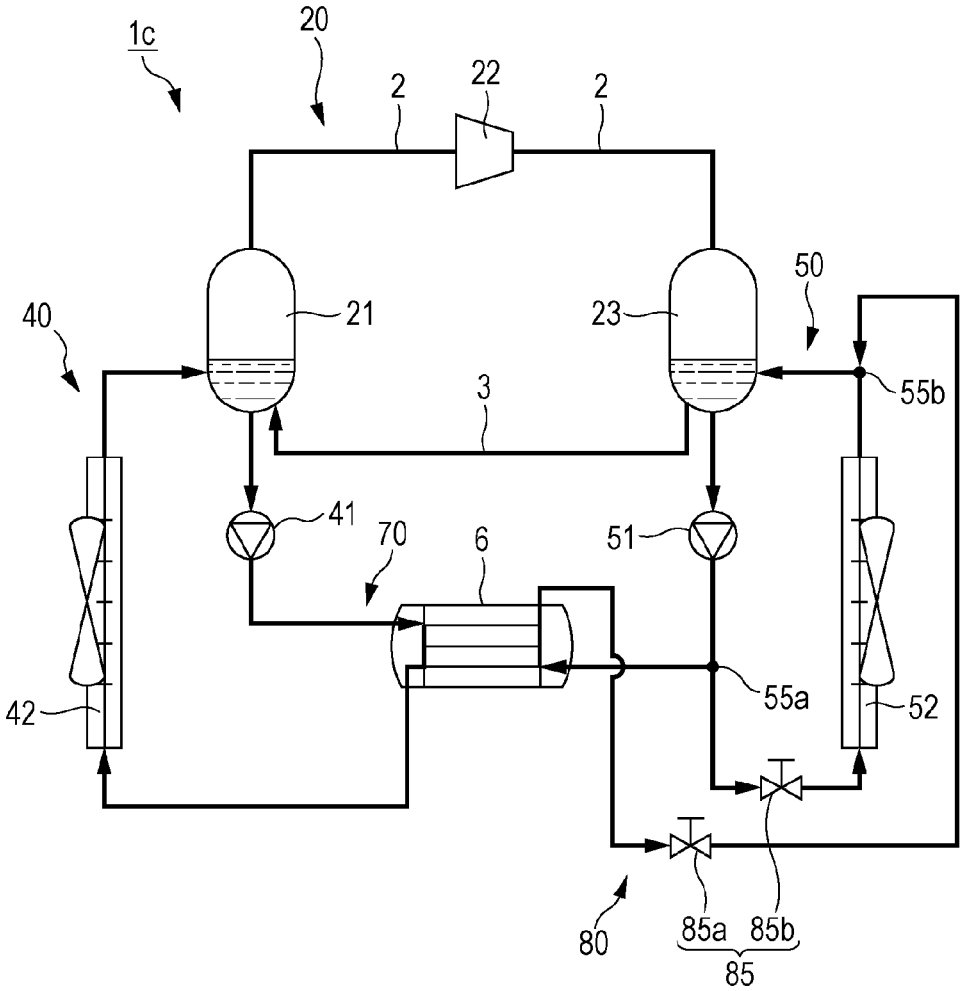
FIG. 3 is a configuration diagram of a refrigerating cycle apparatus of a modification.

Various modifications may be added to the refrigerating cycle apparatus 1*b*. The refrigerating cycle apparatus 1*b* may be modified to be a refrigerating cycle apparatus 1*c*, which is illustrated in FIG. 3. The components of the refrigerating cycle apparatus 1*c* that are not described have the same configurations as those of the refrigerating cycle apparatus 1*b*. The components of the refrigerating cycle apparatus 1*c* that are the same as or corresponding to those of the refrigerating cycle apparatus 1*b* are assigned the same reference numerals as those of the refrigerating cycle apparatus 1*b*.

In the refrigerating cycle apparatus 1*c*, the heat release bypass channel 80 extends from the diverging position 55*a* to the position downstream of the outlet of the heat release heat exchanger 52 in the heat release circuit 50. In other words, the converging position 55*b* is positioned downstream of the outlet of the heat release heat exchanger 52 in the heat release circuit 50. The refrigerant or the heat release heat transfer medium in the heat release bypass channel 80, which has passed through the internal heat exchanger 6, returns to the condenser 23 without passing through the heat release heat exchanger 52. This reduces the pressure loss of the fluid flow through the heat release bypass channel 80, and thus less power is required. As a result, performance of the refrigerating cycle apparatus 1*c* improves. Alternatively, the heat release bypass channel 80 may directly extend to the condenser 23 without converging to the heat release circuit 50.

Figure 4:
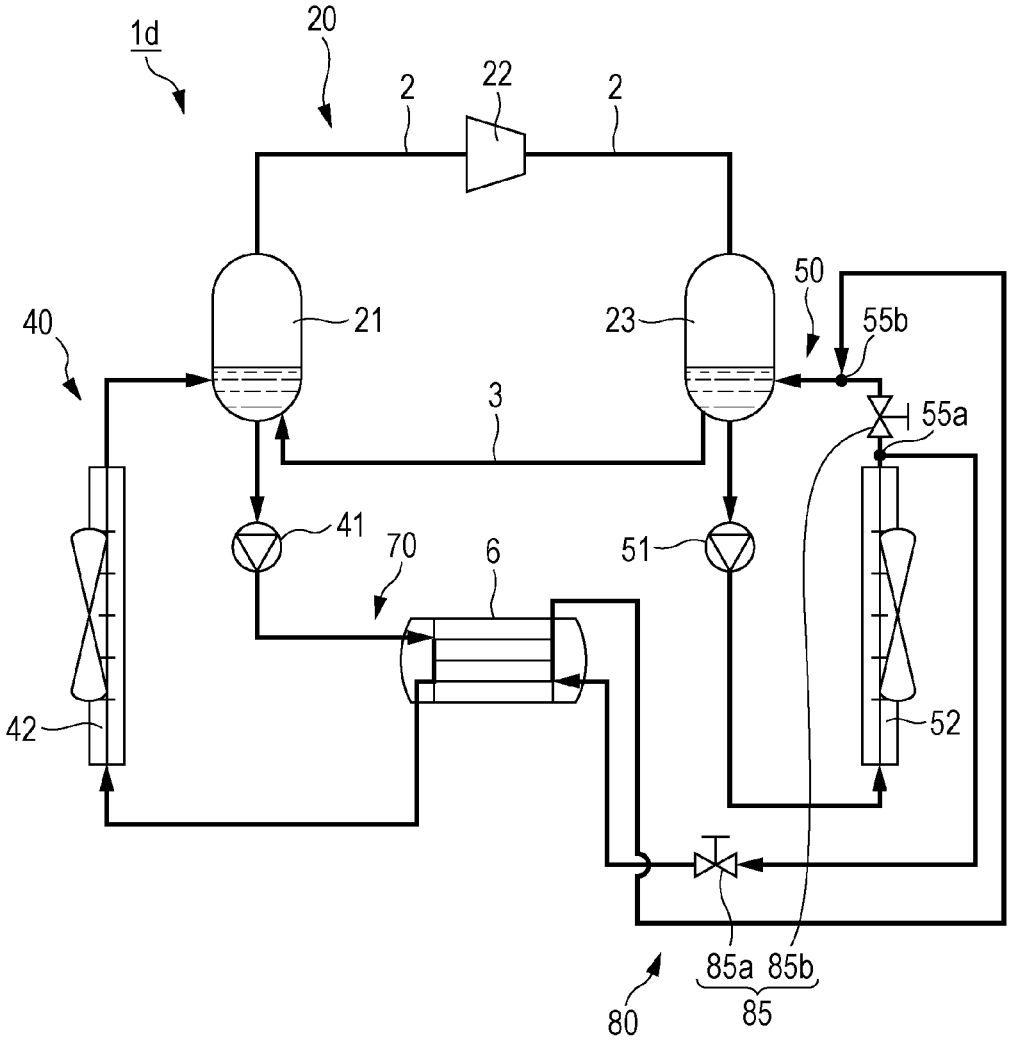
FIG. 4 is a configuration diagram of a refrigerating cycle apparatus of another modification.

The refrigerating cycle apparatus 1*b* may be modified to a refrigerating cycle apparatus 1*d* as illustrated in FIG. 4. The components of the refrigerating cycle apparatus 1*d* that are not described have the same configurations as those of the refrigerating cycle apparatus 1*b*. The components of the refrigerating cycle apparatus 1*d* that are the same as or corresponding to those of the refrigerating cycle apparatus 1*b* are assigned the same reference numerals as those of the refrigerating cycle apparatus 1*b*.

In the refrigerating cycle apparatus 1*d*, the heat release bypass channel 80 enables the refrigerant or the heat release heat transfer medium flowing in a section downstream of the outlet of the heat release heat exchanger 52 in the heat release circuit 50 to be supplied to the internal heat exchanger 6. Specifically, the heat release bypass channel 80 extends from the diverging position 55*a*, which is positioned downstream of the outlet of the heat release heat exchanger 52 in the heat release circuit 50, to the converging position 55*b*, which is positioned downstream of the diverging position 55*a* in the heat release circuit 50, through the internal heat exchanger 6. When the refrigerating cycle apparatus 1*d* performs the defrosting operation, the refrigerant or the heat release heat transfer medium flowing through the heat release circuit 50 after heat release in the heat release heat exchanger 52 is supplied to the internal heat exchanger 6. Thus, the temperature of the refrigerant supplied to the heat release heat exchanger 52 is maintained high during defrosting of the heat absorption heat exchanger 42. As a result, the performance of the heat release heat exchanger 52 is maintained during the defrosting operation. The heat release bypass channel 80 may directly extend to the condenser 23 without converging to the heat release circuit 50.

The position where the heat release bypass channel 80 diverges from the heat release circuit 50 is determined depending on usage or specifications of the refrigerating cycle apparatus such that advantages are obtained.

Third Embodiment

A refrigerating cycle apparatus 1*e* of a third embodiment is described. The components of the refrigerating cycle apparatus 1*e* that are not described have the same configurations as those of the refrigerating cycle apparatus 1*a*. The components of the refrigerating cycle apparatus 1*e* that are the same as or corresponding to those of the refrigerating cycle apparatus 1*a* are assigned the same reference numerals as those of the refrigerating cycle apparatus 1*a*.

Figure 5:
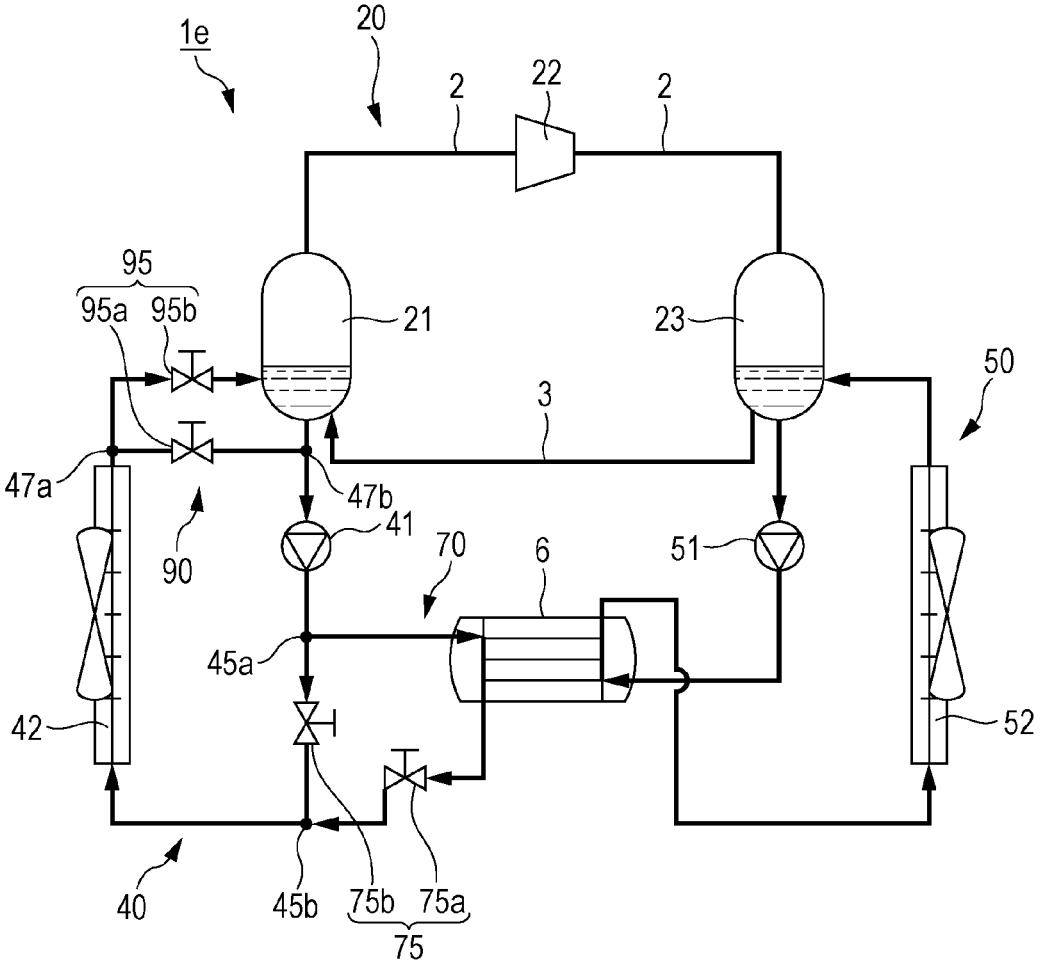
FIG. 5 is a configuration diagram of a refrigerating cycle apparatus of a third embodiment.

As illustrated in FIG. 5, in the refrigerating cycle apparatus 1*e*, the first fluid movement device 41 is disposed upstream of the inlet of the heat absorption heat exchanger 42 in the heat absorption circuit 40. The refrigerating cycle apparatus 1*e* further includes an evaporator bypass channel 90 (third bypass channel) and a return flow rate adjustment mechanism 95 (third adjustment mechanism). The evaporator bypass channel 90 diverges from the heat absorption circuit 40 at a specific position 47*a* downstream of the outlet of the heat absorption heat exchanger 42 and extends to a position 47*b* upstream of the inlet of the first fluid movement device 41 in the heat absorption circuit 40 so as to bypass the evaporator 21. The return flow rate adjustment mechanism 95 adjusts the flow rate of the refrigerant or the heat absorption heat transfer medium that flows through the section downstream of the specific position 47*a* in the heat absorption circuit 40 or the flow rate of the refrigerant or the heat absorption heat transfer medium that flows through the evaporator bypass channel 90. The return flow rate adjustment mechanism 95 includes a return bypass valve 95*a* and a return mainstream valve 95*b*, for example. The return bypass valve 95*a* and the return mainstream valve 95*b* each may be a gate valve such as a magnet valve or a flow regulating valve such as an electric-operated valve, in which opening degree thereof is adjustable. If one of the return bypass valve 95*a* and the return mainstream valve 95*b* is the flow regulating valve, the other one of them may be an orifice. In addition, the return flow rate adjustment mechanism 95 may include a three-way valve at the specific position 47*a*. In such a case, the return bypass valve 95*a* and the return mainstream valve 95*b* are optional components. The three-way valve of the return flow rate adjustment mechanism 95 may be an electric three-way valve, for example.

When the refrigerating cycle apparatus 1*e* is in normal operation, the return flow rate adjustment mechanism 95 controls a flow rate of the fluid flowing through the evaporator bypass channel 90 to be zero or as small as possible. The return bypass valve 95*a* is closed or the opening degree of the return bypass valve 95*a* is controlled to be as small as possible, for example, and the return mainstream valve 95*b* is opened or the opening degree of the return mainstream valve 95*b* is controlled to be a predetermined degree, for example. As a result, almost all the fluid that has passed through the heat absorption heat exchanger 42 returns to the evaporator 21.

For the defrosting operation of the refrigerating cycle apparatus 1*e*, the return flow rate adjustment mechanism 95 is controlled such that the flow rate of the fluid flowing through the evaporator bypass channel 90 is large compared to that in the normal operation. The return bypass valve 95*a* is opened or the opening degree of the return bypass valve 95*a* is controlled to be large, for example. In addition, the return mainstream valve 95*b* is closed or the opening degree of the return mainstream valve 95*b* is controlled to be small, for example. Thus, the fluid that has passed through the heat absorption heat exchanger 42 does not return to the evaporator 21 and is supplied again to the heat absorption circuit 40 at a position upstream of the inlet of the first fluid movement device 41. Therefore, the temperature of the refrigerant in the evaporator 21 is not increased by the fluid that has passed through the heat absorption heat exchanger 42 for defrosting. In addition, the fluid that has been used for defrosting is supplied again to the heat absorption circuit 40 at the position upstream of the inlet of the first fluid movement device 41 while maintaining a relatively high temperature. Thus, the heat loss due to the defrosting is reduced, and the duration of the defrosting operation is shortened. In addition, the refrigerating cycle apparatus 1*e* is able to be back to the normal operation shortly after the defrosting.

Fourth Embodiment

Figure 6:
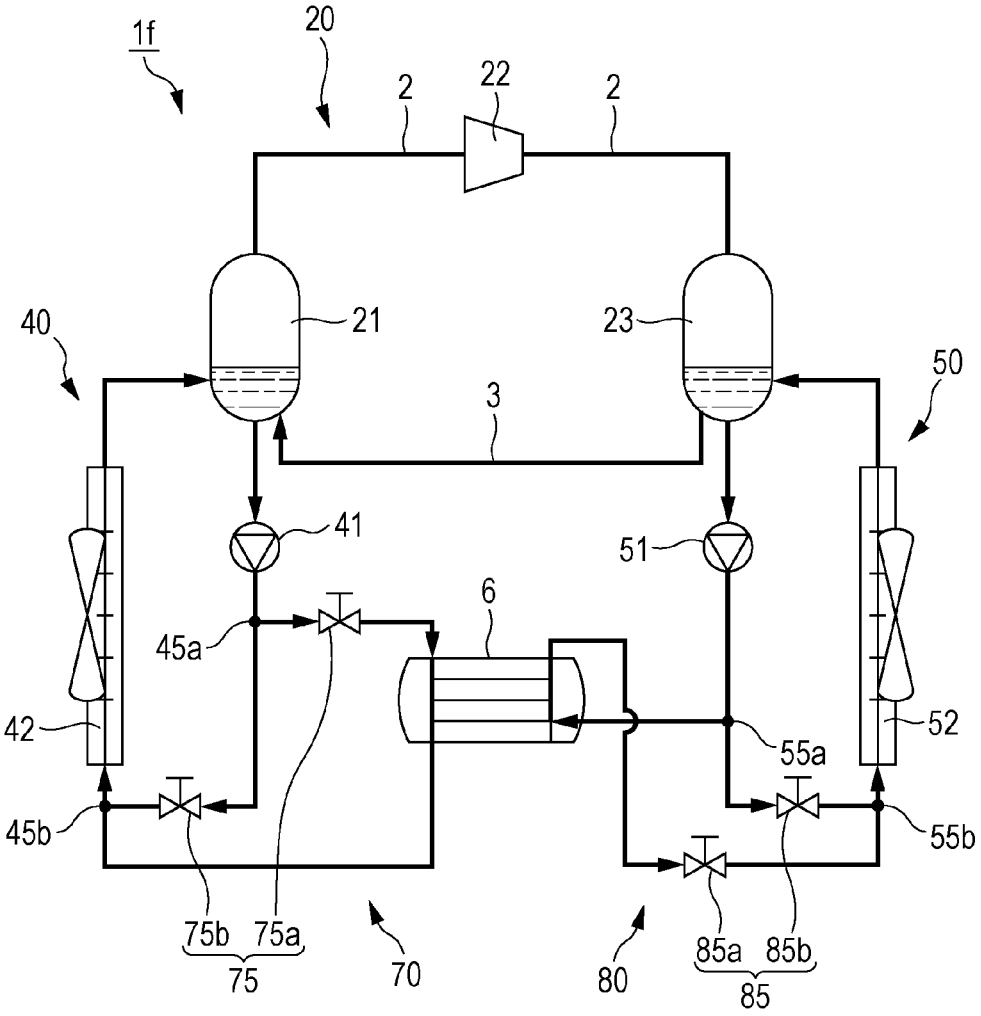
FIG. 6 is a configuration diagram of a refrigerating cycle apparatus of a fourth embodiment.

A refrigerating cycle apparatus 1*f* of a fourth embodiment is described. As illustrated in FIG. 6, the refrigerating cycle apparatus 1*f* includes a heat absorption bypass channel 70, a flow rate adjustment mechanism for heat absorption 75, a heat release bypass channel 80, and a flow rate adjustment mechanism for heat release 85. The heat absorption bypass channel 70 and the flow rate adjustment mechanism for heat absorption 75 of the refrigerating cycle apparatus 1*f* have the same configurations as those of the refrigerating cycle apparatus 1*a*. The heat release bypass channel 80 and the flow rate adjustment mechanism for heat release 85 of the refrigerating cycle apparatus 1*f* have the same configurations as those of the refrigerating cycle apparatus 1*b*. The heat release bypass channel 80 of the refrigerating cycle apparatus 1*f* may be modified to be the heat release bypass channel 80 of the refrigerating cycle apparatus 1*c* or 1*d*.

When the refrigerating cycle apparatus 1*f* performs the refrigerating operation, the fluid flowing through the heat absorption bypass channel 70 is heated by the fluid flowing through the heat release bypass channel 80. Thus, the fluid having a relatively high temperature is supplied to the heat absorption heat exchanger 42, and the heat absorption heat exchanger 42 is defrosted. Furthermore, when the refrigerating cycle apparatus 1*f* performs not the defrosting operation but the normal operation, the fluid in the heat absorption circuit 40 is supplied to the heat absorption heat exchanger 42 without passing through the internal heat exchanger 6, and the fluid in the heat release circuit 50 returns to the condenser 23 without passing through the internal heat exchanger 6. This reduces the pressure loss of the fluid flow in the heat absorption circuit 40 and the pressure loss of the fluid flow in the heat release circuit 50 when the defrosting operation is not performed, and thus less power is required to be applied to the first fluid movement device 41 and the second fluid movement device 51. As a result, performance of the refrigerating cycle apparatus 1*f* improves.

Fifth Embodiment

Figure 7:
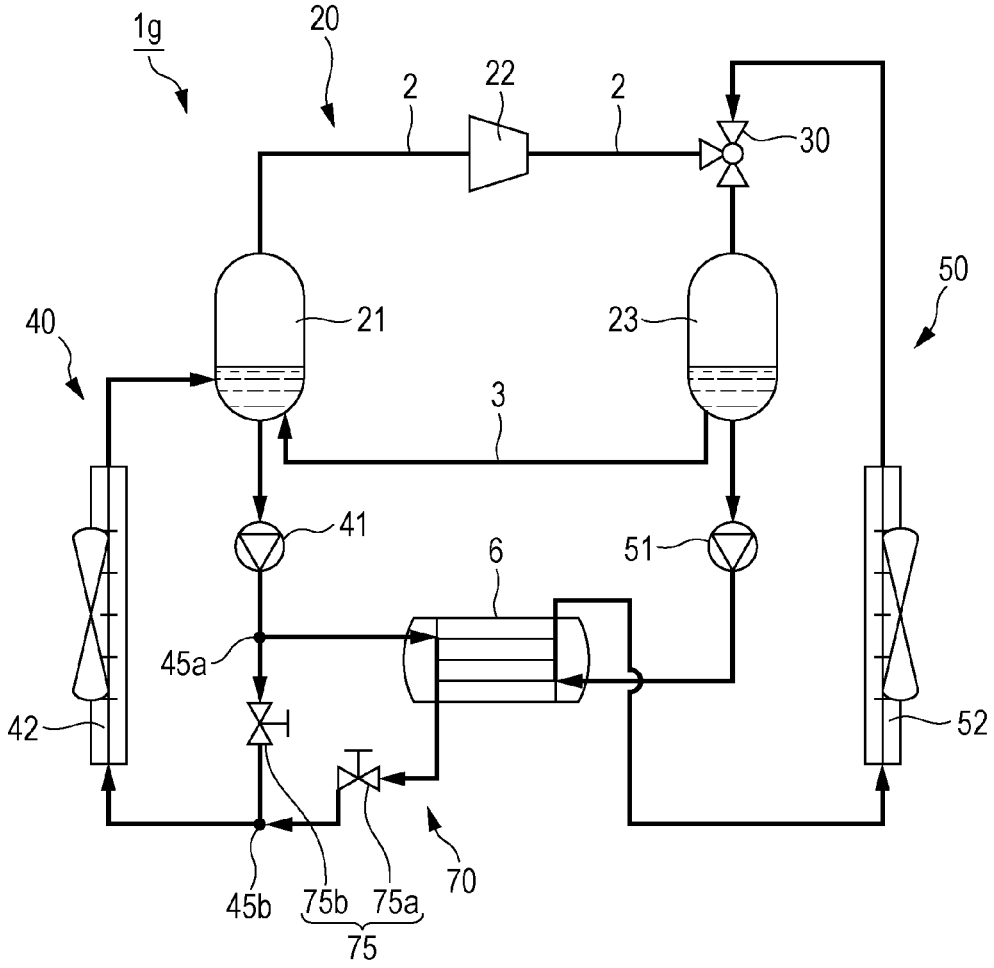
FIG. 7 is a configuration diagram of a refrigerating cycle apparatus of a fifth embodiment.

A refrigerating cycle apparatus 1*g* of a fifth embodiment is described. The components of the refrigerating cycle apparatus 1*g* that are not described have the same configurations as those of the refrigerating cycle apparatus 1*a*. The components of the refrigerating cycle apparatus 1*g* that are the same as or corresponding to those of the refrigerating cycle apparatus 1*a* are assigned the same reference numerals as those of the refrigerating cycle apparatus 1*a*. In the refrigerating cycle apparatus 1*g*, the heat release circuit 50 is connected to the condenser 23 such that the refrigerant stored in the condenser 23 returns to the condenser 23 after being supplied to the heat release heat exchanger 52. As illustrated in FIG. 7, the refrigerating cycle apparatus 1*g* includes an ejector 30. The ejector 30 is disposed downstream of the outlet of the heat release heat exchanger 52 in the heat release circuit 50 and upstream of the condenser 23 in the flow direction of the refrigerant. The ejector 30 sucks the vapor refrigerant, which has been compressed by the compressor 22, by using flow of the liquid refrigerant flowing in the heat release circuit 50 as driving flow.

Figure 8:
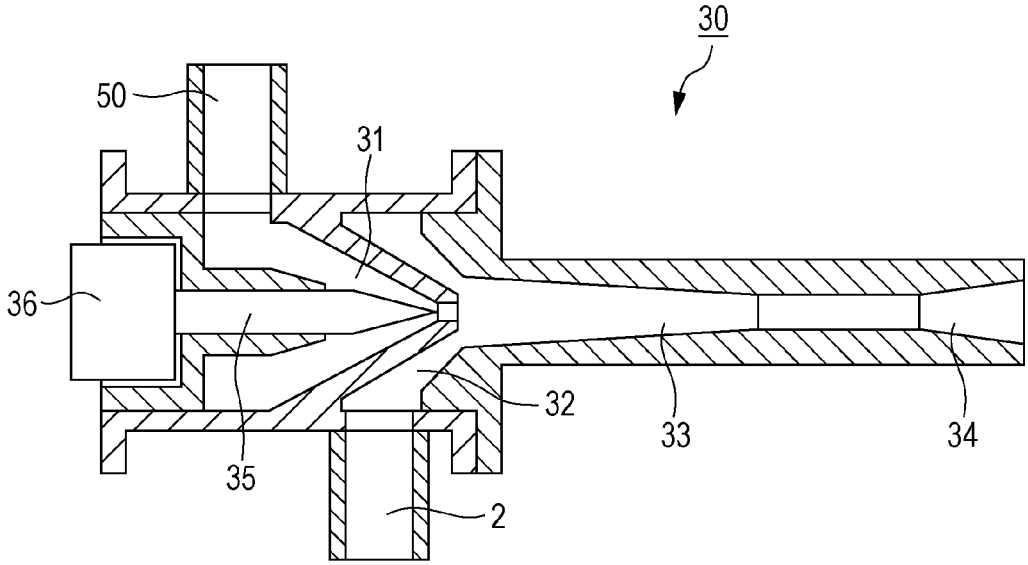
FIG. 8 is a cross-sectional view illustrating a configuration of an ejector in FIG. 7.

As illustrated in FIG. 8, the ejector 30 includes a first nozzle 31, a second nozzle 32, a mixing section 33, a diffuser 34, a needle valve 35, and an actuator 36. The liquid refrigerant expelled from the heat release heat exchanger 52 in the heat release circuit 50 is supplied to the first nozzle 31 as the driving flow. The vapor refrigerant that has been compressed by the compressor 22 is supplied to the second nozzle 32 through the vapor channel 2. When the liquid refrigerant is sprayed from the first nozzle 31, the pressure in the mixing section 33 becomes lower than the pressure in the vapor channel 2. As a result, the vapor refrigerant is continuously sucked into the second nozzle 32 through the vapor channel 2. The liquid refrigerant sprayed from the first nozzle 31 and the vapor refrigerant sprayed through the second nozzle 32 are mixed in the mixing section 33. In other words, the liquid refrigerant as the driving flow ejected in the form of spray from the ejector 30 contacts with the vapor refrigerant compressed by the compressor 22. The ejector 30 exhibits high condensation performance. This enables the condenser 23 to have a small size. Furthermore, the pressure of the vapor refrigerant increases in many cases due to transfer of energy between the liquid refrigerant and the vapor refrigerant and transfer of momentum between the liquid refrigerant and the vapor refrigerant. The increase in pressure increases the saturation temperature of the refrigerant stored in the condenser 23, and thus the performance of the refrigerating cycle apparatus 1*g* improves. The diffuser 34 recovers a static pressure by decelerating the flow of the refrigerant.

The needle valve 35 and the actuator 36 can adjust the flow rate of the liquid refrigerant as the driving flow. The needle valve 35 can change the cross-sectional area of the orifice positioned at the front end of the first nozzle 31. The actuator 36 can adjust the position of the needle valve 35. With this configuration, the flow rate of the liquid refrigerant flowing through the first nozzle 31 is adjusted.

Sixth Embodiment

A refrigerating cycle apparatus 1*h* of a sixth embodiment is described. The components of the refrigerating cycle apparatus 1*h* that are not described have the same configurations as those of the refrigerating cycle apparatus 1*b*. The components of the refrigerating cycle apparatus 1*h* that are the same as or corresponding to those of the refrigerating cycle apparatus 1*b* are assigned the same reference numerals as those of the refrigerating cycle apparatus 1*b*.

Figure 9A:
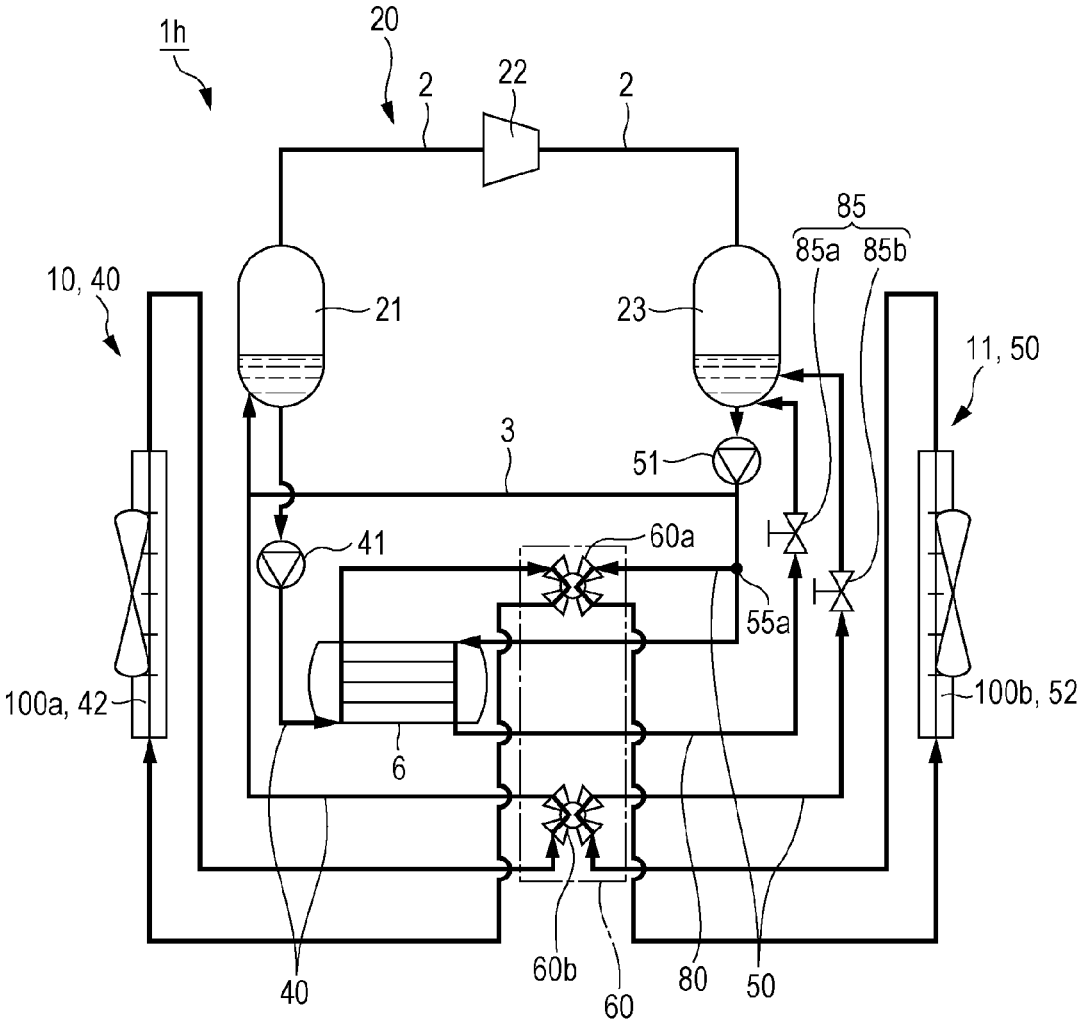
FIG. 9A is a configuration diagram of a refrigerating cycle apparatus of a sixth embodiment.

As illustrated in FIG. 9A, the refrigerating cycle apparatus 1*h* includes a first heat exchanger 100*a* and a second heat exchanger 100*b*. The first heat exchanger 100*a* functions as the heat absorption heat exchanger 42 or the heat release heat exchanger 52. The second heat exchanger 100*b* functions as the heat absorption heat exchanger 42 or the heat release heat exchanger 52. The first heat exchanger 100*a* is located outside, and the second heat exchanger 100*b* is located inside, for example. The refrigerating cycle apparatus 1*h* includes a switching mechanism 60 that switches the state of the refrigerating cycle apparatus 1*h* between a first state and a second state. FIG. 9A illustrates the refrigerating cycle apparatus 1*h* in the first state. The switching mechanism 60 includes an upstream four-way valve 60*a* and a downstream four-way valve 60*b*, for example.

A portion of the heat absorption circuit 40 is formed by a channel that extends from the evaporator 21 to the upstream four-way valve 60*a* through the first fluid movement device 41 and the internal heat exchanger 6. Another portion of the heat absorption circuit 40 is formed by a channel that extends from the downstream four-way valve 60*b* to the evaporator 21. The refrigerating cycle apparatus 1*h* includes a first channel 10 including the first heat exchanger 100*a* and a second channel 11 including the second heat exchanger 100*b*. The first channel 10 functions as a part of the heat absorption circuit 40 when the first heat exchanger 100*a* functions as the heat absorption heat exchanger 42. The first channel 10 is connected to the upstream four-way valve 60*a* at one end and connected to the downstream four-way valve 60*b* at the other end. The second channel 11 functions as a part of the heat absorption circuit 40 when the second heat exchanger 100*b* functions as the heat absorption heat exchanger 42. The second channel 11 is connected to the upstream four-way valve 60*a* at one end and connected to the downstream four-way valve 60*b* at the other end. The heat absorption circuit 40 is connected to the evaporator 21 such that the refrigerant stored in the evaporator 21 returns to the evaporator 21 after being supplied to the heat absorption heat exchanger 42.

A portion of the heat release circuit 50 is formed by a channel extending from the condenser 23 to the upstream four-way valve 60*a* through the second fluid movement device 51. Another portion of the heat release circuit 50 is formed by a channel extending from the downstream four-way valve 60*b* to the condenser 23. The first channel 10 functions as a part of the heat release circuit 50 when the first heat exchanger 100*a* functions as the heat release heat exchanger 52. The second channel 11 functions as a part of the heat release circuit 50 when the second heat exchanger 100*b* functions as the heat release heat exchanger 52. The heat release circuit 50 is connected to the condenser 23 such that the refrigerant stored in the condenser 23 returns to the condenser 23 after being supplied to the heat release heat exchanger 52.

The heat release bypass channel 80 extends from the diverging position 55*a*, which is positioned between the outlet of the second fluid movement device 51 in the heat release circuit 50 and the upstream four-way valve 60*a*, to the condenser 23 through the internal heat exchanger 6. The flow rate adjustment mechanism for heat release 85 includes the heat release bypass valve 85*a* and the heat release mainstream valve 85*b*. The heat release bypass valve 85*a* is disposed on the heat release bypass channel 80. The heat release mainstream valve 85*b* is disposed between the downstream four-way valve 60*b* and the condenser 23 in the heat release circuit 50.

In the first state, the first fluid movement device 41 forces the refrigerant stored in the evaporator 21 to return to the evaporator 21 after being supplied to the first heat exchanger 100*a*, and the second fluid movement device 51 forces the refrigerant stored in the condenser 23 to return to the condenser 23 after being supplied to the second heat exchanger 100*b*. In the first state, the first heat exchanger 100*a* functions as the heat absorption heat exchanger 42 and the second heat exchanger 100*b* functions as the heat release heat exchanger 52. In this state, the section upstream of the upstream four-way valve 60*a* in the heat absorption circuit 40 is connected to the first channel 10 by the upstream four-way valve 60*a*, and the section upstream of the upstream four-way valve 60*a* in the heat release circuit 50 is connected to the second channel 11 by the upstream four-way valve 60*a*. Furthermore, the first channel 10 is connected to the section downstream of the downstream four-way valve 60*b* in the heat absorption circuit 40 by the downstream four-way valve 60*b*, and the second channel 11 is connected to the section downstream of the downstream four-way valve 60*b* in the heat release circuit 50 by the downstream four-way valve 60*b*.

When the refrigerating cycle apparatus 1*h* performs the defrosting operation in the first state, the flow rate adjustment mechanism for heat release 85 is controlled such that at least a portion of the refrigerant flowing through the heat release circuit 50 is supplied to the heat release bypass channel 80. Thus, the refrigerant flowing from the section upstream of the inlet of the heat absorption heat exchanger 42 in the heat absorption circuit 40 is heated in the internal heat exchanger 6 by the refrigerant flowing through the heat release bypass channel 80. As a result, the refrigerant having a relatively high temperature is supplied to the heat absorption heat exchanger 42, and the heat absorption heat exchanger 42 is defrosted.

Figure 9B:
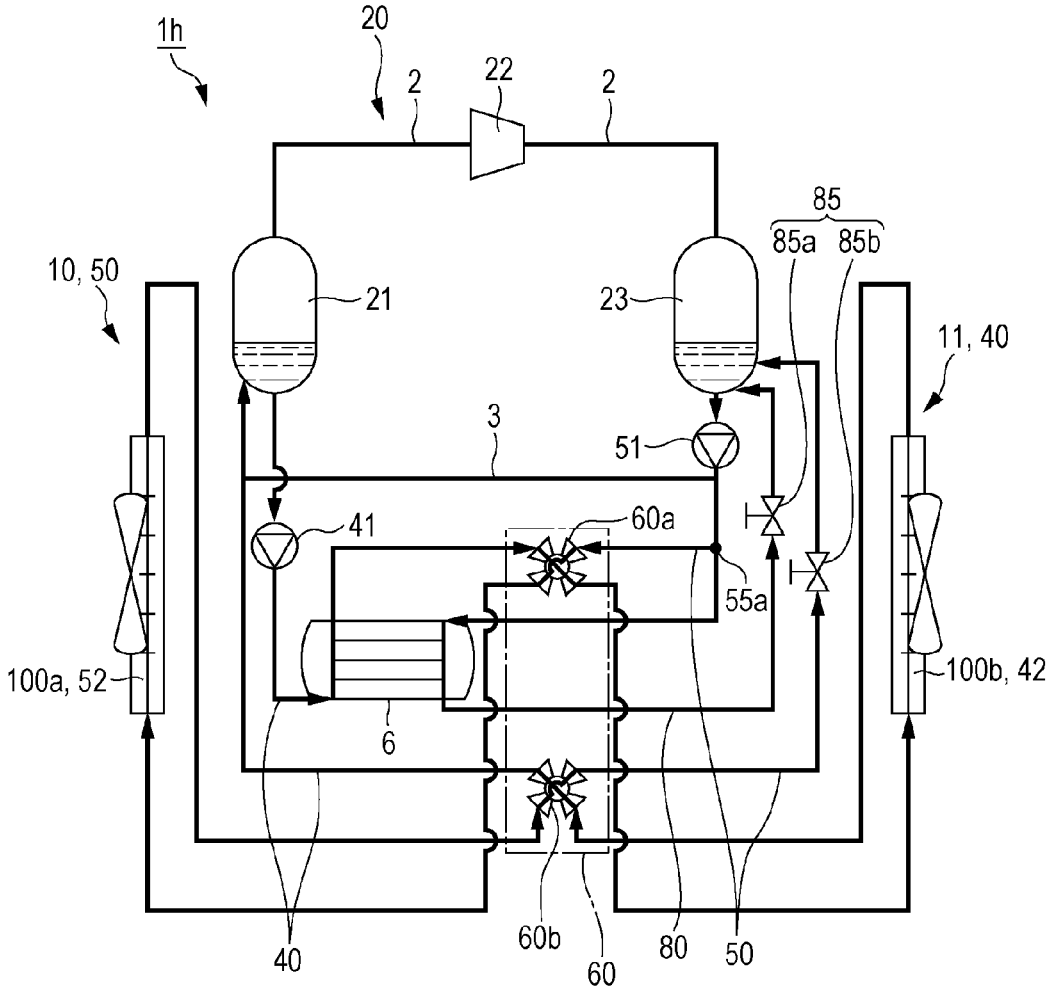
FIG. 9B is a configuration diagram of the refrigerating cycle apparatus of the sixth embodiment.
Figure 10:
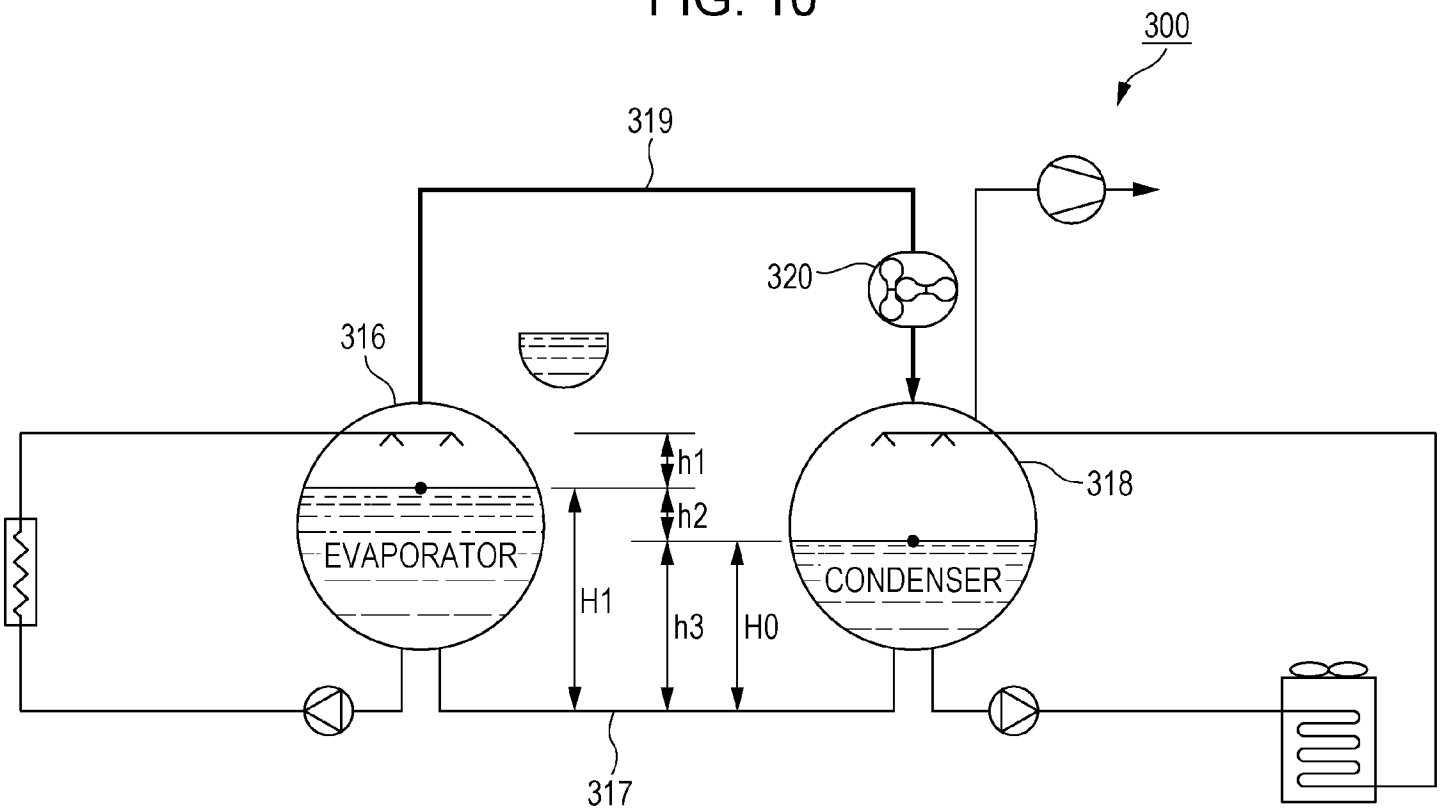
FIG. 10 is a configuration diagram of a conventional refrigerating apparatus that uses water as a refrigerant.
Figure 11:
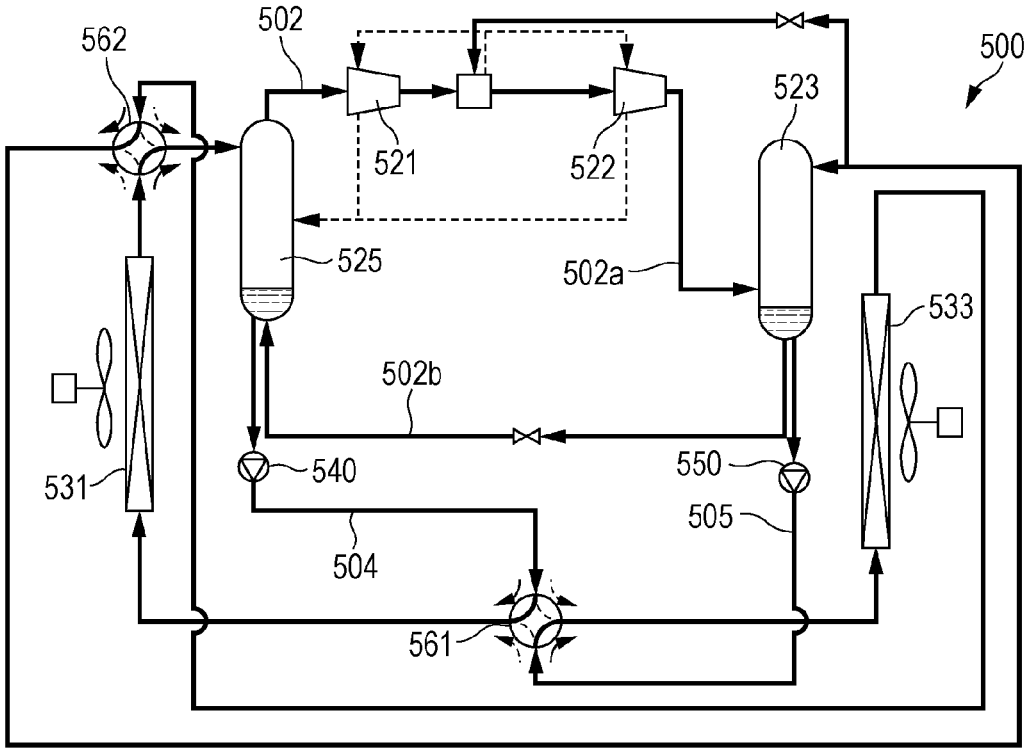
FIG. 11 is a configuration diagram of a conventional air conditioner.

FIG. 9B illustrates the refrigerating cycle apparatus 1*h* in the second state. In the second state, the first fluid movement device 41 forces the refrigerant stored in the evaporator 21 to return to the evaporator 21 after being supplied to the second heat exchanger 100*b*, and the second fluid movement device 51 forces the refrigerant stored in the condenser 23 to return to the condenser 23 after being supplied to the first heat exchanger 100*a*. In the second state, the first heat exchanger 100*a* functions as the heat release heat exchanger 52 and the second heat exchanger 100*b* functions as the heat absorption heat exchanger 42. In this state, the section upstream of the upstream four-way valve 60*a* in the heat absorption circuit 40 is connected to the second channel 11 by the upstream four-way valve 60*a*, and the section upstream of the upstream four-way valve 60*a* in the heat release circuit 50 is connected to the first channel 10 by the upstream four-way valve 60*a*. Furthermore, the second channel 11 is connected to the section downstream of the downstream four-way valve 60*b* in the heat absorption circuit 40 by the downstream four-way valve 60*b*, and the first channel 10 is connected to the section downstream of the downstream four-way valve 60*b* in the heat release circuit 50 by the downstream four-way valve 60*b*.

When the refrigerating cycle apparatus 1*h* performs the defrosting operation in the second state, the flow rate adjustment mechanism for heat release 85 is controlled such that at least a portion of the refrigerant flowing through the heat release circuit 50 is supplied to the heat release bypass channel 80. Thus, the refrigerant flowing from the section upstream of the inlet of the heat absorption heat exchanger 42 in the heat absorption circuit 40 is heated in the internal heat exchanger 6 by the refrigerant flowing through the heat release bypass channel 80. As a result, the refrigerant having a relatively high temperature is supplied to the heat absorption heat exchanger 42, and the heat absorption heat exchanger 42 is defrosted.

As described above, the refrigerating cycle apparatus 1*h* operating in the first state or the second state does not require switching between the first state and the second state to perform defrosting operation. If the refrigerating cycle apparatus 1*h* is used in an air conditioner, the heating mode and the cooling mode are switched when the switching between the first state and the second state is performed by the switching mechanism 60.

In the refrigerating cycle apparatus 1*h*, the feeding channel 3 includes an upstream section, a middle section, and a downstream section in this order from the condenser 23 to the evaporator 21. The upstream section of the feeding channel 3 is formed by an upstream end section of the heat release circuit 50 and is connected to the condenser 23. The downstream section of the feeding channel 3 is formed by a downstream end section of the heat absorption circuit 40 and is connected to the evaporator 21. One end and the other end of the middle section of the feeding channel 3 is connected to the upstream section and the downstream section of the feeding channel 3, respectively. The second fluid movement device 51 is disposed in a section of the heat release circuit 50, which is the upstream section of the feeding channel 3. With this configuration, the liquid refrigerant stored in the condenser 23 is supplied to the evaporator 21 by the second fluid movement device 51.

The switching mechanism 60 only has to be configured to switch the state between the first state and the second state. The upstream four-way valve 60*a* and the downstream four-way valve 60*b* each may be replaced with a combination of two three-way valves that functions as the same way as the four-way valve.

The refrigerating cycle apparatus of the present disclosure is particularly advantageous when used in a domestic or industrial air conditioner. The refrigerating apparatus of the present disclosure may be used in other apparatuses such as a chiller and an electric storage device.

What is claimed is:

1. A refrigerating cycle apparatus comprising:

a first circuit that circulates a refrigerant flowing therein;

a second circuit that circulates the refrigerant flowing therein;

a third circuit that circulates the refrigerant flowing therein;

an evaporator that is commonly disposed on the first circuit and the second circuit, that stores the refrigerant in liquid form, and that evaporates the refrigerant;

a compressor that compresses the evaporated refrigerant;

a condenser that is commonly disposed on the first circuit and the third circuit, that stores the refrigerant in liquid form, and that condenses the compressed refrigerant;

a first heat exchanger that is disposed on the second circuit and that heats the refrigerant;

a first pump that is disposed on the second circuit and that circulates the refrigerant;

a second heat exchanger that is disposed on the third circuit and that cools the refrigerant;

a second pump that is disposed on the third circuit and that circulates the refrigerant, wherein the refrigerant's saturated vapor pressure at ordinary temperature is a negative pressure, the second circuit comprises a first portion and a second portion, the second portion being positioned between the first portion and a portion where the refrigerant flows into the evaporator, the third circuit comprises a third portion and a fourth portion, the fourth portion being positioned between the third portion and a portion where the refrigerant flows into the condenser, the refrigerating cycle apparatus further comprises at least one selected from the group of:

a first bypass channel that connects the first portion to the second portion, in the first bypass channel the refrigerant flowing from the first portion to the second portion; and a second bypass channel that connects the third portion to the fourth portion, in the second bypass channel the refrigerant flowing from the third portion to the fourth portion, a third heat exchanger that is sharedly disposed on the first bypass channel and the third circuit, on the second circuit and the second bypass channel, or on the first bypass channel and the second bypass channel, the refrigerant cycle apparatus further comprises at least one selected from the group of:

a first adjustment mechanism that adjusts a ratio of an amount of the refrigerant flowing in the first bypass channel to an amount of the refrigerant flowing from the first portion to the second portion in the second circuit; and a second adjustment mechanism that adjusts a ratio of an amount of the refrigerant flowing in the second bypass channel to an amount of the refrigerant flowing from the third portion to the fourth portion in the third circuit.

2. The refrigerating cycle apparatus according to claim 1, wherein the refrigerating apparatus comprises the second bypass channel and the second adjustment mechanism, and the third portion is positioned between the portion where the refrigerant flows out from the condenser and a portion where the refrigerant flows into the second heat exchanger.

3. The refrigerating cycle apparatus according to claim 2, wherein the fourth portion is positioned between a portion where the refrigerant flows out from the second heat exchanger and the portion where the refrigerant flows into the condenser.

4. The refrigerating cycle apparatus according to claim 1, wherein the refrigerating apparatus comprises the second bypass channel and the second adjustment mechanism, and the third portion is positioned between the portion where the refrigerant flows out from the second heat exchanger and the portion where the refrigerant flows into the condenser.

5. The refrigerating cycle apparatus according to claim 1, wherein the first pump is positioned between the portion where the refrigerant flows out from the evaporator and a portion where the refrigerant flows into the first heat exchanger, the second circuit comprises a fifth portion and a sixth portion, the fifth portion being positioned between the portion where the refrigerant flows out from the evaporator and a portion where the refrigerant flows into the first pump, the sixth portion being positioned between a portion where the refrigerant flows out from the first heat exchanger and the portion where the refrigerant flows into the evaporator, and the refrigerating apparatus further comprises:

a third bypass channel that connects the fifth portion to the sixth portion, in the third bypass channel the refrigerant flowing from the fifth portion to the sixth portion; and a third adjustment mechanism that adjusts a ratio of an amount of the refrigerant flowing in the third bypass channel to an amount of the refrigerant flowing from the fifth portion to the sixth portion in the second circuit.

6. The refrigerating cycle apparatus according to claim 1, wherein the refrigerating apparatus comprises the first bypass channel, the first adjustment mechanism, the second bypass channel, and the second adjustment mechanism.

7. The refrigerating cycle apparatus according to claim 1, wherein the refrigerating apparatus further comprises an ejector that is sharedly disposed on the first circuit and the third circuit, that sucks the compressed vapor refrigerant flowing in the first circuit by using flow of the refrigerant in liquid form flowing in the third circuit as driving flow.

8. A refrigerating cycle apparatus comprising:

a first circuit that circulates a refrigerant flowing therein;

a second circuit that circulates a first heat transfer medium flowing therein;

a third circuit that circulates a second heat transfer medium flowing therein;

an evaporator that is commonly disposed on the first circuit and the second circuit, that transfers heat of the first heat transfer medium to the refrigerant, and that evaporates the refrigerant;

a compressor that compresses the evaporated refrigerant;

a condenser that is commonly disposed on the first circuit and the third circuit, that transfers heat of the refrigerant to the second heat transfer medium, and that condenses the compressed refrigerant;

a first heat exchanger that is disposed on the second circuit and that heats the first heat transfer medium;

a first pump that is disposed on the second circuit and that circulates the first heat transfer medium;

a second heat exchanger that is disposed on the third circuit and that cools the second heat transfer medium;

a second pump that is disposed on the third circuit and that circulates the second heat transfer medium, wherein the refrigerant's saturated vapor pressure at ordinary temperature is a negative pressure, the second circuit comprises a first portion and a second portion, the second portion being positioned between the first portion and a portion where the first heat transfer medium flows into the evaporator, the third circuit comprises a third portion and a fourth portion, the fourth portion being positioned between the third portion and a portion where the second heat transfer medium flows into the condenser, the refrigerating cycle apparatus further comprises at least one selected from the group of:

a first bypass channel that connects the first portion to the second portion, in the first bypass channel the first heat transfer medium flowing from the first portion to the second portion; and a second bypass channel that connects the third portion to the fourth portion, in the second bypass channel the second heat transfer medium flowing from the third portion to the fourth portion, a third heat exchanger that is sharedly disposed on the first bypass channel and the third circuit, on the second circuit and the second bypass channel, or on the first bypass channel and the second bypass channel, the refrigerant cycle apparatus further comprises at least one selected from the group of:

a first adjustment mechanism that adjusts a ratio of an amount of the first heat transfer medium flowing in the first bypass channel to an amount of the first heat transfer medium flowing from the first portion to the second portion in the second circuit; and a second adjustment mechanism that adjusts a ratio of an amount of the second heat transfer medium flowing in the second bypass channel to an amount of the second heat transfer medium flowing from the third portion to the fourth portion in the third circuit.

9. The refrigerating cycle apparatus according to claim 8, wherein the refrigerating apparatus comprises the second bypass channel and the second adjustment mechanism, and the third portion is positioned between the portion where the second heat transfer medium flows out from the condenser and a portion where the second heat transfer medium flows into the second heat exchanger.

10. The refrigerating cycle apparatus according to claim 9, wherein the fourth portion is positioned between a portion where the second heat transfer medium flows out from the second heat exchanger and the portion where the second heat transfer medium flows into the condenser.

11. The refrigerating cycle apparatus according to claim 8, wherein the refrigerating apparatus comprises the second bypass channel and the second adjustment mechanism, and the third portion is positioned between the portion where the second heat transfer medium flows out from the second heat exchanger and the portion where the second heat transfer medium flows into the condenser.

12. The refrigerating cycle apparatus according to claim 8, wherein the first pump is positioned between the portion where the first heat transfer medium flows out from the evaporator and a portion where the first heat transfer medium flows into the first heat exchanger, the second circuit comprises a fifth portion and a sixth portion, the fifth portion being positioned between the portion where the first heat transfer medium flows out from the evaporator and a portion the first heat transfer medium flows into the first pump, the sixth portion being positioned between a portion where the first heat transfer medium flows out from the first heat exchanger and the portion where the first heat transfer medium flows into the evaporator, and the refrigerating apparatus further comprises:

a third bypass channel that connects the fifth portion to the sixth portion, in the third bypass channel the first heat transfer medium flowing from the fifth portion to the sixth portion; and a third adjustment mechanism that adjusts a ratio of an amount of the first heat transfer medium flowing in the third bypass channel to an amount of the first heat transfer medium flowing from the fifth portion to the sixth portion in the second circuit.

13. The refrigerating cycle apparatus according to claim 8, wherein the refrigerating apparatus comprises the first bypass channel, the first adjustment mechanism, the second bypass channel, and the second adjustment mechanism.

* * * * *